US011667455B2

(12) United States Patent
Barfoot et al.

(10) Patent No.: US 11,667,455 B2
(45) **Date of Patent: *Jun. 6, 2023**

(54) CONFIGURABLE CONTAINER

(71) Applicant: Otter Products, LLC, Fort Collins, CO (US)

(72) Inventors: Grady E. Barfoot, Denver, CO (US); Joshua R. Cornish, Fort Collins, CO (US); W. Travis Smith, Fort Collins, CO (US); Alan V. Morine, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/070,691

(22) Filed: Nov. 29, 2022

(65) Prior Publication Data

US 2023/0089527 A1 Mar. 23, 2023

Related U.S. Application Data

(63) Continuation of application No. 17/586,091, filed on Jan. 27, 2022, now Pat. No. 11,542,088, which is a (Continued)

(51) Int. Cl.
*B65D 81/20* (2006.01)
*B65D 5/49* (2006.01)

(Continued)

(52) U.S. Cl.
CPC ..... *B65D 81/2076* (2013.01); *B65D 5/48024* (2013.01); *B65D 81/2092* (2013.01);

(Continued)

(58) Field of Classification Search
CPC .... B65D 25/06; B65D 81/18; B65D 81/3813; B65D 81/3818; B65D 81/3816;

(Continued)

(56) References Cited

U.S. PATENT DOCUMENTS 1,468,563 A 9/1923 Girard
2,496,296 A 2/1950 Frederick (Continued)

FOREIGN PATENT DOCUMENTS

EP 3061704 A1 8/2016
WO 2004029526 A1 4/2004

(Continued)

OTHER PUBLICATIONS

U.S. Appl. No. 16/566,191, filed Sep. 10, 2019, Jonathan H. Guerdrum.

(Continued)

*Primary Examiner* — Chun Hoi Cheung
*Assistant Examiner* — Brijesh V. Patel

(57) ABSTRACT

A configurable container includes a first divider and a container body. The divider has a divider body and a first projection extending from the divider body, wherein the first projection has a length having a first dimension and a width having a second dimension different than the first dimension. The container body includes a first wall that includes a first groove facing inward toward the internal cavity, wherein the first groove has a width configured to receive the width of the first projection of the first divider in a first orientation. At least one of the first wall and a second wall includes a second groove also facing inward toward the internal cavity, wherein the second groove has a width configured to receive the length of the first projection in a second orientation, wherein the width of the second groove is different than the width of the first groove.

20 Claims, 26 Drawing Sheets

Related U.S. Application Data continuation of application No. 17/022,961, filed on Sep. 16, 2020, now Pat. No. 11,267,637, which is a continuation-in-part of application No. 16/995,948, filed on Aug. 18, 2020, now Pat. No. 11,242,175.

(60) Provisional application No. 62/889,808, filed on Aug. 21, 2019.

(51) Int. Cl.
*F25C 5/182* (2018.01)
*B65D 81/38* (2006.01)
*F25D 3/08* (2006.01)

(52) U.S. Cl.
CPC ..... *B65D 81/3823* (2013.01); *F25C 5/182* (2013.01); *F25D 3/08* (2013.01); *B65D 2543/00101* (2013.01); *B65D 2543/00203* (2013.01); *F25C 2400/00* (2013.01); *F25D 2331/804* (2013.01)

(58) Field of Classification Search
CPC ..... B65D 81/382; B65D 81/2076; B65D 81/2092; B65D 81/3823; B65D 5/48024; B65D 2543/00101; B65D 2543/00203; B65D 11/1833; F25C 5/182; F25C 2400/00; F25D 3/08; F25D 2331/804; F25D 2303/08222; F25D 2303/0843
USPC ... 220/6, 7, 4.28, 404, 462, 463, 666, 62.21, 220/23.87, 23.89, 915.2, 592.2, 1.6, 220/495.06, 592.24, 592.23, 529, 554, 220/510, 592.01, 23.83, 532–533, 512, 220/216, 578, 915.1, 500, 544, DIG. 9; 206/546, 514, 559, 139, 425; 217/3 BC, 217/128, 131, 7; 62/457.7, 457.1, 382, 62/372, 459; 190/109–110, 9; 229/545, 229/120.02, 120.06, 120.07
See application file for complete search history.

(56) References Cited

U.S. PATENT DOCUMENTS 2,610,759 A 9/1952 Slade
2,627,993 A 2/1953 Hafner
2,632,311 A 3/1953 Sullivan
2,635,779 A 4/1953 Pfeiffer
3,200,983 A 8/1965 Walter
3,347,060 A 10/1967 Barkan
3,395,550 A 8/1968 Dungan
3,398,850 A 8/1968 John
3,401,535 A 9/1968 Palmer
3,436,932 A 4/1969 Paquin
3,605,431 A 9/1971 Carson
3,658,035 A 4/1972 Harris
3,675,808 A 7/1972 Brink
3,850,398 A 11/1974 Kantor
3,868,829 A 3/1975 Mann et al.
3,939,986 A 2/1976 Pierro
3,961,708 A 6/1976 Dohlen et al.
4,024,731 A 5/1977 Branscum
4,143,695 A 3/1979 Hoehn
4,172,365 A 10/1979 McClintock
4,213,310 A 7/1980 Buss
4,235,346 A 11/1980 Liggett
4,319,629 A 3/1982 Hotta
4,336,883 A 6/1982 Krug et al.
4,344,301 A 8/1982 Taylor
4,372,444 A 2/1983 Grand et al.
4,441,336 A 4/1984 Cannon
D275,822 S 10/1984 Gatland et al.
4,499,997 A 2/1985 Swingley, Jr.
4,499,998 A 2/1985 Carlson
4,509,587 A 4/1985 Clark et al.
4,515,421 A 5/1985 Steffes
4,529,092 A 7/1985 Swingley, Jr.
4,560,128 A 12/1985 Willeby et al.
4,577,773 A 3/1986 Bitel
4,606,461 A 8/1986 Bolton
D285,413 S 9/1986 Carlson
4,746,008 A 5/1988 Heverly et al.
4,759,467 A 7/1988 Byrne
RE32,740 E 8/1988 Steffes
4,782,977 A 11/1988 Watanabe et al.
4,819,793 A 4/1989 Willard et al.
4,841,661 A 6/1989 Moore
4,872,589 A 10/1989 Englehart et al.
4,923,077 A 5/1990 Iperen et al.
4,964,528 A 10/1990 Wagoner
4,988,216 A 1/1991 Lyman
5,050,766 A 9/1991 Groh
5,052,185 A 10/1991 Spahr
D325,323 S 4/1992 Kahl
5,102,001 A 4/1992 Teague et al.
5,103,884 A 4/1992 Roman
5,103,998 A 4/1992 Caro et al.
D327,427 S 6/1992 McCooey
D328,389 S 8/1992 Pardo
D330,488 S 10/1992 Daniels
5,181,612 A 1/1993 Liu
5,215,248 A 6/1993 Moser
5,285,656 A 2/1994 Peters
5,299,688 A 4/1994 McKay et al.
5,318,218 A 6/1994 Mattson
5,329,787 A 7/1994 Friday
5,353,946 A 10/1994 Behrend
D353,082 S 12/1994 Keven
D354,419 S 1/1995 Kahl et al.
5,390,797 A 2/1995 Smalley et al.
5,403,095 A 4/1995 Melk
5,405,012 A 4/1995 Shindler et al.
5,427,446 A 6/1995 Glomski
5,447,041 A 9/1995 Piechota
5,493,874 A 2/1996 Landgrebe
5,509,279 A 4/1996 Brown et al.
5,522,239 A 6/1996 Schwartz et al.
5,562,228 A 10/1996 Ericson
5,605,056 A 2/1997 Brown et al.
5,622,276 A 4/1997 Simmons
5,669,233 A 9/1997 Cook et al.
5,676,252 A 10/1997 Lillelund et al.
5,676,273 A 10/1997 Jonkers et al.
D387,249 S 12/1997 Mogil
1,391,121 A 2/1998 Melk
5,816,432 A 10/1998 Hammen et al.
5,845,515 A 12/1998 Nelson
5,850,915 A 12/1998 Tajima
5,857,778 A 1/1999 Ells
5,913,448 A 6/1999 Mann et al.
D419,297 S 1/2000 Richardson et al.
D419,767 S 2/2000 Richardson et al.
D419,768 S 2/2000 Richardson et al.
6,026,978 A 2/2000 Clegg et al.
6,039,202 A 3/2000 Olstad et al.
D425,761 S 5/2000 Philipson et al.
6,065,873 A 5/2000 Fowler
D435,196 S 12/2000 Gregor et al.
6,185,860 B1 2/2001 Thibodeaux
6,193,097 B1 2/2001 Perianes
D441,261 S 5/2001 Stein
6,226,844 B1 5/2001 Lerra et al.
6,234,677 B1 5/2001 Mogil
6,244,458 B1 6/2001 Frysinger et al.
D444,683 S 7/2001 Corrion
6,276,579 B1 8/2001 DeLoach
6,295,830 B1 10/2001 Newman
6,318,114 B1 11/2001 Slaughter
D451,765 S 12/2001 Israel et al.
6,325,281 B1 12/2001 Grogan
6,328,179 B1 12/2001 Conrado et al.
6,336,342 B1 1/2002 Zeddies
D455,934 S 4/2002 Culp et al.

(56) References Cited

U.S. PATENT DOCUMENTS 6,409,066 B1 6/2002 Schneider et al.
1,465,134 A1 11/2002 Joss
6,474,095 B1 11/2002 Chan
D469,012 S 1/2003 Lee
6,505,479 B2 1/2003 Defelice et al.
D472,384 S 4/2003 Richardson
6,582,124 B2 6/2003 Mogil
6,595,687 B2 7/2003 Godshaw et al.
6,736,309 B1 5/2004 Westerman et al.
6,751,963 B2 6/2004 Navedo et al.
6,782,711 B2 8/2004 Abfalter
D502,599 S 3/2005 Cabana et al.
6,895,778 B1 5/2005 Ackerman
6,966,450 B2 11/2005 Askew
D513,122 S 12/2005 Greene
D513,123 S 12/2005 Richardson et al.
D514,808 S 2/2006 Morine et al.
6,993,931 B1 2/2006 Hamilton
7,004,323 B1 2/2006 Symonds
D516,807 S 3/2006 Richardson et al.
D527,226 S 8/2006 Maldonado
D527,953 S 9/2006 Gal
7,140,507 B2 11/2006 Maldonado et al.
7,147,125 B1 12/2006 Slovak et al.
7,195,127 B2 3/2007 Hsu et al.
D543,030 S 5/2007 Schäfer
7,257,963 B2 8/2007 Mayer
D553,999 S 10/2007 Mason
7,296,433 B2 11/2007 Uihlein et al.
D558,599 S 1/2008 Tilman et al.
D569,902 S 5/2008 Chang et al.
7,389,608 B1 6/2008 MacKay
7,415,794 B1 8/2008 Thompson
7,422,143 B2 9/2008 Mayer
7,682,080 B2 3/2010 Mogil
D623,075 S 9/2010 Blythe
D623,947 S 9/2010 Levy
7,791,003 B2 9/2010 Lockhart et al.
7,810,350 B2 10/2010 Shelton
7,882,706 B2 2/2011 Thali et al.
7,900,816 B2 3/2011 Kastanek et al.
7,908,870 B2 3/2011 Williams et al.
D635,832 S 4/2011 Bergin
D637,044 S 5/2011 Davis
7,950,246 B1 5/2011 Mayer et al.
7,984,820 B2 7/2011 Dancyger
D643,629 S 8/2011 Sofy et al.
3,011,194 A1 9/2011 Dimmitt
3,043,004 A1 10/2011 Mogil
D649,587 S 11/2011 Nemeth et al.
3,061,159 A1 11/2011 Mogil et al.
3,061,522 A1 11/2011 Eskenazi et al.
3,061,547 A1 11/2011 Camp, Jr.
8,065,889 B1 11/2011 Silberman
D659,014 S 5/2012 Blythe
8,209,995 B2 7/2012 Kieling et al.
8,246,190 B2 8/2012 Boiteau et al.
8,317,046 B2 11/2012 Vanderberg et al.
8,365,944 B2 2/2013 Vanderberg et al.
8,403,162 B2 3/2013 Vanderberg et al.
8,418,874 B2 4/2013 Ahlgrim et al.
8,424,699 B2 4/2013 Vanderberg et al.
8,430,265 B2 4/2013 Vanderberg et al.
8,448,813 B2 5/2013 Vanderberg et al.
8,607,581 B2 12/2013 Williams et al.
8,608,015 B2 12/2013 Wolf et al.
D697,770 S 1/2014 Khuu
8,622,235 B2 1/2014 Suchecki
D699,119 S 2/2014 Fukuda et al.
D712,720 S 9/2014 Seiders
D712,721 S 9/2014 Seiders
D712,722 S 9/2014 Seiders
D712,723 S 9/2014 Seiders
D714,125 S 9/2014 Seiders
8,844,316 B1 9/2014 Ademola et al.
8,863,546 B2 10/2014 Oberweis
8,875,964 B1 11/2014 Vanderberg
8,910,819 B2 12/2014 Seiders
8,919,082 B1 12/2014 Cataldo
8,925,752 B2 1/2015 Smith
D722,474 S 2/2015 Seiders
D722,475 S 2/2015 Seiders
D726,816 S 4/2015 Ehrlich et al.
9,022,249 B2 5/2015 Ranade
D730,649 S 6/2015 Thomas
D732,348 S 6/2015 Seiders et al.
D732,349 S 6/2015 Seiders et al.
D732,350 S 6/2015 Seiders et al.
D732,899 S 6/2015 Seiders et al.
9,108,790 B2 8/2015 Daley
9,139,352 B2 9/2015 Seiders et al.
9,182,168 B2 11/2015 Hernandez et al.
9,187,232 B2 11/2015 Seiders
9,205,962 B2 12/2015 Holderby
D748,978 S 2/2016 Glass et al.
D752,347 S 3/2016 Seiders et al.
9,290,297 B2 3/2016 Overath
9,314,143 B2 4/2016 Bensussan et al.
9,316,428 B2 4/2016 Mech
D757,534 S 5/2016 Matsuura
9,389,010 B1 7/2016 Booker
9,408,445 B2 8/2016 Mogil et al.
9,433,200 B2 9/2016 Norman
9,446,847 B2 9/2016 Richardson et al.
9,500,400 B2 11/2016 Smith
9,540,138 B2 1/2017 Dubois et al.
D778,614 S 2/2017 Ananian et al.
9,834,342 B2 4/2017 Seiders
D785,334 S 5/2017 Holt et al.
D786,559 S 5/2017 Seiders et al.
D786,560 S 5/2017 Seiders et al.
D786,561 S 5/2017 Seiders et al.
D786,562 S 5/2017 Seiders et al.
D787,187 S 5/2017 Seiders et al.
D797,454 S 9/2017 Seiders et al.
D797,455 S 9/2017 Seiders et al.
9,751,682 B2 9/2017 Mayer et al.
D798,670 S 10/2017 Seiders et al.
D799,276 S 10/2017 Seiders et al.
D799,277 S 10/2017 Seiders et al.
D799,905 S 10/2017 Seiders et al.
D801,123 S 10/2017 Seiders et al.
9,796,517 B2 10/2017 Seiders et al.
D802,373 S 11/2017 Seiders et al.
D803,041 S 11/2017 Patterson
9,809,357 B2 11/2017 Arnold et al.
D804,905 S 12/2017 Seiders et al.
D805,851 S 12/2017 Seiders et al.
9,920,977 B1 3/2018 Avila
9,981,778 B2 5/2018 Plattner
D820,646 S 6/2018 Yockey
D821,165 S 6/2018 Guerdrum et al.
D821,825 S 7/2018 Sullivan et al.
D823,064 S 7/2018 Eichinger et al.
D823,065 S 7/2018 Eichinger et al.
D823,066 S 7/2018 Eichinger et al.
10,029,842 B2 7/2018 Seiders et al.
D824,730 S 8/2018 Guerdrum et al.
10,046,900 B2 8/2018 Seiders
D828,029 S 9/2018 Seiders et al.
10,092,137 B1 10/2018 Nelson et al.
D835,470 S 12/2018 Seiders et al.
D835,471 S 12/2018 Seiders et al.
D835,472 S 12/2018 Seiders et al.
D835,946 S 12/2018 Seiders et al.
D838,983 S 1/2019 Seiders et al.
D838,984 S 1/2019 Seiders et al.
D840,150 S 2/2019 Seiders et al.
10,221,005 B2 3/2019 James
D845,717 S 4/2019 Cavenagh et al.
D850,865 S 6/2019 Smith et al.
10,351,330 B2 7/2019 Smith et al.
D856,673 S 8/2019 Stirnimann et al.
10,392,180 B1 8/2019 Travis et al.

(56) References Cited

U.S. PATENT DOCUMENTS

| | | | |
|---|---|---|---|
| 10,443,918 | B2 | 10/2019 | Li et al. |
| 10,676,235 | B1 | 6/2020 | Song et al. |
| 10,676,267 | B2 | 6/2020 | Seiders et al. |
| D908,357 | S | 1/2021 | Guerdrum et al. |
| D912,400 | S | 3/2021 | Guerdrum et al. |
| 2003/0038138 | A1 | 2/2003 | Komurke |
| 2003/0106895 | A1 | 6/2003 | Kalal |
| 2003/0136702 | A1 | 7/2003 | Redzisz et al. |
| 2003/0141424 | A1 | 7/2003 | Thomas |
| 2004/0143944 | A1 | 7/2004 | Huang |
| 2004/0178208 | A1 | 9/2004 | Leba et al. |
| 2004/0238543 | A1 | 12/2004 | Askew |
| 2004/0262319 | A1 | 12/2004 | Fisher |
| 2005/0006268 | A1 | 1/2005 | Futernick |
| 2005/0133557 | A1 | 6/2005 | McKenzie et al. |
| 2005/0263527 | A1 | 12/2005 | Maldonado et al. |
| 2005/0263528 | A1 | 12/2005 | Maldonado et al. |
| 2005/0279123 | A1 | 12/2005 | Maldonado et al. |
| 2005/0279124 | A1 | 12/2005 | Maldonado |
| 2005/0279666 | A1 | 12/2005 | Deng et al. |
| 2005/0281487 | A1 | 12/2005 | Pawloski et al. |
| 2006/0065655 | A1 | 3/2006 | Taylor |
| 2006/0169658 | A1 | 8/2006 | Lim et al. |
| 2006/0180624 | A1 | 8/2006 | Sadow et al. |
| 2007/0028642 | A1 | 2/2007 | Glade et al. |
| 2007/0137958 | A1 | 6/2007 | Hamlin |
| 2007/0186579 | A1 | 8/2007 | Barker |
| 2007/0267426 | A1 | 11/2007 | M. et al. |
| 2007/0277546 | A1 | 12/2007 | Lehman |
| 2007/0278234 | A1 | 12/2007 | Mogil |
| 2008/0094853 | A1 | 4/2008 | Kim et al. |
| 2008/0121630 | A1 | 5/2008 | Simard |
| 2008/0128428 | A1 | 6/2008 | Beckerman |
| 2008/0257918 | A1 | 10/2008 | Vogel et al. |
| 2008/0260303 | A1 | 10/2008 | Lesseux et al. |
| 2008/0296194 | A1 | 12/2008 | Stahl |
| 2008/0307824 | A1 | 12/2008 | Botich |
| 2009/0052809 | A1 | 2/2009 | Sampson |
| 2009/0078709 | A1 | 3/2009 | Murrer, III |
| 2009/0159471 | A1 | 6/2009 | Koppe |
| 2009/0218342 | A1 | 9/2009 | Pickles |
| 2009/0261111 | A1 | 10/2009 | Hsu |
| 2010/0001018 | A1 | 1/2010 | Puma |
| 2010/0065466 | A1 | 3/2010 | Perkins |
| 2010/0072215 | A1 | 3/2010 | Coon |
| 2010/0287976 | A1 | 11/2010 | Roof et al. |
| 2011/0056233 | A1 | 3/2011 | Flaker et al. |
| 2011/0182532 | A1 | 7/2011 | Baltus |
| 2011/0203297 | A1 | 8/2011 | Oberweis |
| 2011/0220531 | A1 | 9/2011 | Meether et al. |
| 2011/0289958 | A1 | 12/2011 | White et al. |
| 2011/0290792 | A1 | 12/2011 | Krzak et al. |
| 2012/0043289 | A1 | 2/2012 | Brown et al. |
| 2013/0200083 | A1 | 8/2013 | Cunningham |
| 2013/0228583 | A1 | 9/2013 | Mayer |
| 2013/0264161 | A1 | 10/2013 | Thompson |
| 2014/0013789 | A1 | 1/2014 | Conrad et al. |
| 2014/0054195 | A1 | 2/2014 | Hallman |
| 2014/0124406 | A1 | 5/2014 | Ishikawa et al. |
| 2014/0131225 | A1 | 5/2014 | Couch et al. |
| 2014/0248003 | A1 | 9/2014 | Mogil et al. |
| 2015/0068242 | A1 | 3/2015 | Patstone |
| 2015/0158539 | A1 | 6/2015 | Jensen et al. |
| 2015/0175338 | A1 | 6/2015 | Culp et al. |
| 2015/0210444 | A1 | 7/2015 | Mercado et al. |
| 2015/0241107 | A1 | 8/2015 | Mech |
| 2015/0298886 | A1 | 10/2015 | Knight et al. |
| 2015/0369529 | A1 | 12/2015 | Monroe |
| 2016/0023837 | A1 | 1/2016 | Furneaux et al. |
| 2016/0059990 | A1 | 3/2016 | Patikas-Bryant |
| 2016/0101924 | A1 | 4/2016 | Mitchell et al. |
| 2016/0176577 | A1 | 6/2016 | Frankenberg et al. |
| 2016/0257471 | A1 | 9/2016 | Rud |
| 2016/0257479 | A1 | 9/2016 | Seiders et al. |
| 2016/0279840 | A1 | 9/2016 | French et al. |
| 2016/0347507 | A1 | 12/2016 | Kendrick |
| 2016/0355319 | A1 | 12/2016 | Stephens |
| 2017/0001785 | A1 | 1/2017 | Ripley et al. |
| 2017/0023289 | A1 | 1/2017 | Anderson |
| 2017/0073146 | A1 | 3/2017 | Kuhn et al. |
| 2017/0073147 | A1 | 3/2017 | Kuhn |
| 2017/0115046 | A1 | 4/2017 | Blezard et al. |
| 2017/0121059 | A1 | 5/2017 | Faris |
| 2017/0233139 | A1 | 8/2017 | Averill |
| 2017/0245486 | A1 | 8/2017 | Larson et al. |
| 2017/0305639 | A1 | 10/2017 | Kuhn et al. |
| 2017/0314836 | A1 | 11/2017 | Donnell et al. |
| 2017/0350635 | A1 | 12/2017 | Thirumurugavel |
| 2018/0009101 | A1 | 1/2018 | Piccininni et al. |
| 2018/0015938 | A1 | 1/2018 | DeFrancia |
| 2018/0016060 | A1 | 1/2018 | Peach et al. |
| 2018/0141718 | A1 | 5/2018 | Ahlström et al. |
| 2018/0141739 | A1 | 5/2018 | Hengen |
| 2018/0149400 | A1 | 5/2018 | Valencia |
| 2018/0184775 | A1 | 7/2018 | Altschul et al. |
| 2018/0186547 | A1 | 7/2018 | Morine et al. |
| 2018/0186550 | A1 | 7/2018 | Morine et al. |
| 2018/0187962 | A1 | 7/2018 | Stollenwerck, III |
| 2018/0202700 | A1 | 7/2018 | Ansted et al. |
| 2018/0263346 | A1 | 9/2018 | Stephens |
| 2018/0290814 | A1 | 10/2018 | Smith |
| 2018/0335241 | A1 | 11/2018 | Li et al. |
| 2018/0346229 | A1 | 12/2018 | Guerdrum et al. |
| 2018/0353379 | A1 | 12/2018 | Chou et al. |
| 2018/0360178 | A1 | 12/2018 | Bungert |
| 2019/0023480 | A1 | 1/2019 | Lin |
| 2019/0092554 | A1 | 3/2019 | Rogers et al. |
| 2019/0144164 | A1 | 5/2019 | Breyburg |
| 2019/0297870 | A1 | 10/2019 | Johnson |
| 2020/0102126 | A1 | 4/2020 | Guerdrum et al. |
| 2020/0109889 | A1 | 4/2020 | Kieling et al. |
| 2020/0165055 | A1 | 5/2020 | Barfoot et al. |
| 2020/0189794 | A1 | 6/2020 | Pefley et al. |
| 2021/0016955 | A1 | 1/2021 | Morine et al. |
| 2021/0139225 | A1 | 5/2021 | Morine et al. |

FOREIGN PATENT DOCUMENTS

| | | | |
|---|---|---|---|
| WO | 2006007266 | A2 | 1/2006 |
| WO | 2006009537 | A1 | 1/2006 |
| WO | 2014105962 | A1 | 7/2014 |
| WO | 2016154105 | A1 | 9/2016 |

OTHER PUBLICATIONS amazon.com, "Farberware 5190590 3-piece cutting board set," dated Jul. 23, 2011, downloaded from https ://www.amazon.com/Farberware-5190590-3-Piece-Plastic-Assorted/dp/80731KDNM P/ref=cm_cr_arp _d_product_top?e=UTF8 Mar. 11, 2019, 8 pages.

Best Buy, "OtterBox Separator for Venture Coolers—Slate Gray," downloaded from https://www.bestbuy.com/site/otterbox-separator-for-venture-coolers-slate-gray/5824901.p?sku Id=5824901 Nov. 4, 2018, 5 pages.

Best Cooler Reviews, Best Folding and Collapsible Cooler—It's All About Convenience, downloaded from https://bestcooler.reviews/best-folding-collapsible-cooler/ Jan. 15, 2018, 8 pages.

Clevermade, CleverMade CleverCrates 45 Liter Collapsible Storage Bin/Container; Grated Wall Utility Basket/Tote, Royal Blue, downloaded from https://www.amazon.com/CleverMade-CleverCrates-Collapsible-Storage-Container/dp/B00UM4D63W/ref=sr_1_8?ie=UTF8&qid=1516048768&sr=8-8&keywords=collapsible%2Bmilk%2Bcrate&th=1, Jan. 15, 2018, 13 pages.

Coleman, 75 Can Collapsible Sport Cooler, downloaded from https://www.coleman.com/large-sport-collapsible/2000015225.html Jan. 15, 2018, 3 pages.

Digital Trends, "The new Venture coolers from Otterbox . . . ", Posted May 9, 2017.(https://www.digitaltrends.com/outdoors/otterbox-venture-coolers/).

Duluth Trading Co, Folding Milk Crate, downloaded from https://www.duluthtrading.com/store/product/folding-milk-crate-78536.aspx on Jan. 15, 2018, 6 pages.

(56) References Cited

OTHER PUBLICATIONS

Fulton, Wil, All the Major Meal Delivery Services, Tested and Ranked, dated Oct. 7, 2016, downloaded from https://www.thrillist.com/eat/nation/best-meal-delivery-services-food-subscription-boxes-ranked on Jan. 15, 2018, 18 pages.
Ice Chest Guide, "Top 10 Best Soft Cooler Reviews and Buying Guide for 2018", downloaded from http://www.icechestguide.com/top-10-best-soft-cooler-reviews-and-buying-guide.html Jan. 25, 2018, 12 pages.
Igloo, Marine Ultra TM Collapse and Cool TM 50, downloaded from https://www.igloocoolers.com/products/61582-marine-ultra-collapse-and-cool-50-can-cooler-bag-white Jan. 15, 2018, 4 pages.
KELTY Folding Cooler, downloaded from https://www.kelty.com/folding-cooler/ Jan. 18, 2018, 6 pages.
Morris, David Z., This box opens up new possibilities for fresh food delivery, dated Aug. 3, 2015, downloaded from http://fortune.com/2015/08/03/freshrealm-cold-delivery/ Jan. 15, 2018, 4 pages.
NRS, "NRS Big Sky Cooler Divider at nrs.com," downloaded from https://www.nrs.com/product/4450/nrs-big-sky-cooler-divider Nov. 4, 2018, 4 pages.
Otterbox, "Cooler Divider OtterBox Venture Cooler Accessory," downloaded from www.otterbox.com/en-us/venture/separator/otr56-cooler-acc-separator. html#start= 1 Nov. 4, 2018, 4 pages.
Otterbox, "Rugged Venture Coolers", Accessed Jan. 16, 2018. (https://www.otterbox.com/en-us/venture-coolers.html).
Pelican Consumer, Coolers—Hunting, Fishing, Camping, downloaded from http://www.pelican.com/us/en/products/coolers May 8, 2017, 2 pages.
Pelican Products, "70QT Cooler", Accessed Jan. 16, 2018. (http://www.pelican.com/us/en/product/outdoor-heavy-dutycoolers/elite-cooler/cooler/70QT/).
Picnic at Ascot, 396-RB 60 Can Collapsible Rolling Cooler, downloaded from http://www.picnicatascot.com/main/default/ProductsDetail.aspx?id=136 Jan. 15, 2018, 2 pages.
Polar Bear Coolers, "24 Pack Eclipse Cooler," downloaded from http://www.polarbearcoolers.com/product/PB327.html Jan. 30, 2018, 6 pages.
Polar Bear Coolers, "Eclipse Backpack Cooler," downloaded from http://www.polarbearcoolers.com/product/PB397.html Jan. 29, 2018, 4 pages.
REI Co-Op, "Soft-sided Coolers", downloaded from https://www.rei.com/c/soft-sided-coolers?r-c&origin+web&ir=category%3Asoft-sided-coolers%page=1 Jan. 25, 2018, 6 pages.
RTIC, "RTIC Soft Pack Coolers," downloaded form https://www.rticcoolers.com/shop/coolers/softpak Jan. 25, 2018, 16 pages.
RTIC, Cooler Accessories, downloaded May 8, 2017 from http://www.rticcoolers.com/shop/coolers/accessories, 14 pages.
Stay Cool Hot Stuff, Flip-Box XL Collapsible Cooler and Insulation Box, downloaded from https://staycoolhotstuff.com/products/flip-box-xl-collapsible-cooler-and-insulation-box Jan. 18, 2018, 5 pages.
The Cooler Box, "Cordova Coolers vs Yeti—Is This New Cooler Better Than Yeti?", Published Oct. 24, 2016.(http://thecoolerbox.com/cordova-coolers-vs-yeti/).
The Good Housekeeping Institute, Thermos Cold N' Fold Cooler, dated Jul. 2007, downloaded from http://www.goodhousekeeping.com/travel-products/food-cooler-reviews/a28866/thermos-cold-n-fold-cooler-101/ Jan. 18, 2018, 5 pages.
Walmart, ECR4Kids Large Vented Collapsible Crate, 12pk, downloaded from https://www.walmart.com/ip/ECR4Kids-Large-Vented-Collapsible-Crate-12pk/34702630 on Jan. 15, 2018, 7 pages.
Yeti Coolers, "Hopper Soft Sided Portable Coolers," downloaded from https://www.yeti.com/soft-coolers Jan. 25, 2018, 6 pages.
Yeti Coolers, "Tundra Cooler Divider," dated Mar. 11, 2014, downloaded from https://www.yeti.com/en_US/accessories/tundra-dividers/DV.html?cg id =accessories# Mar. 11, 2019, 9 pages.
Yeti Coolers, Tundra Cooler Divider, downloaded from www.yeti.com/tundra-dividers May 8, 2017, 4 pages.
Yeti Coolers, Tundra Ice Chests, downloaded from http://yeti.com/tundra May 8, 2017, 7 pages.
Yeti Coolers, Yeti Accessories & Parts, downloaded from http://yeti.com/accessories May 8, 2017, 5 pages.

CONFIGURABLE CONTAINER

CROSS REFERENCE TO RELATED APPLICATIONS

The present application is a continuation of U.S. patent application Ser. No. 17/586,091, filed Jan. 27, 2022, which is a continuation of U.S. patent application Ser. No. 17/022,961, filed Sep. 16, 2020, now U.S. Pat. No. 11,267,637, which is a continuation in part of U.S. patent application Ser. No. 16/995,948, filed Aug. 18, 2020, now U.S. Pat. No. 11,242,175, which claims priority to U.S. Provisional Patent Application No. 62/889,808, filed Aug. 21, 2019, all of which are hereby incorporated by reference in their entireties.

FIELD

This disclosure relates generally to portable storage containers for storing or shipping objects, and more particularly to portable storage containers such as for storing or shipping food and/or beverages.

BACKGROUND

Food and beverage delivery services have grown in recent years. It is also often desirable to bring food or beverages when traveling or when participating in remote leisure activities. Often, the food may be perishable and the ambient temperature may be high (for instance, at a beach location), so it may be desirable to keep the perishable food in a temperature controlled environment to avoid spoiling. Similarly, beverages, such as canned or bottled beverages, may also be consumed, and it is desired to keep such beverages cool until consumption. Storage containers, insulated storage containers, coolers, and/or insulated shipping containers may also be used for a variety of other purposes or activities including hunting, fishing, camping, medical purposes, general storage, grocery delivery, meal kit shipping, other food delivery, and/or other business or personal purposes. Some exemplary storage containers are disclosed in U.S. patent application Ser. No. 15/982,059, filed May 17, 2018, which is hereby incorporated by reference in its entirety.

Ice packs, cold packs, and/or cooling packs may be placed in an interior portion of a storage container defined by the side walls and bottom wall to keep the interior portion of the storage container at a desired temperature that is lower than the ambient temperature. In some cases, it may be desirable to separate the contents of the storage container into two or more groups. It may also be desirable to secure the ice packs and/or contents of the storage container to keep them from shifting during shipping or transport of the container. It is therefore desirable to be able to configure the storage container to accommodate these varied needs, as well as to be able to easily reconfigure the storage container for subsequent uses which have different configuration needs.

SUMMARY

Storage containers are used for a variety of purposes and in conjunction with a variety of activities. A storage container may be insulated to assist in keeping one or more items cool, cold, frozen, warm, or hot. The storage container may also be used to protect one or more items from damage, bumps, scratching, impact, water, rain, snow, mud, dust, dirt, light, visibility, theft, chemicals, and/or contaminants. While most of the examples discussed herein are discussed with respect to a "cooler," it should be understood that the techniques and features disclosed herein are applicable to other types of storage containers or temperature control containers. Further, storage containers of the type disclosed herein may be used for storage or transportation purposes and need not necessarily include insulating characteristics. The storage containers disclosed herein may be configured to be carried or transported in a plurality of manners or configurations.

In one example, a portable storage container includes a first divider and an insulated body. The first divider includes a first projection defining a length having a first dimension and a width having a second dimension. The insulated body has an internal cavity configured for storing items and at least partially bounded by a bottom, a first wall, and a second wall opposite the first wall. The first wall includes a first groove configured to receive the first projection in a first orientation. One of the first wall and the second wall includes a second groove configured to receive the first projection in a second orientation. The first groove has a width configured to receive the width of the first projection and the second groove has a width configured to receive the length of the first projection.

In one example, a portable storage container includes a first divider and a body. The first divider includes a first projection having a length having a first dimension and a width having a second dimension. The body has an internal cavity configured for storing items and at least partially bounded by a bottom, a first wall, and a second wall opposite the first wall. The first wall includes a first groove configured to receive the first projection in a first orientation. One of the first wall and the second wall includes a second groove configured to receive the first projection in a second orientation. The first groove has a width configured to receive the width of the first projection and the second groove has a width configured to receive the length of the first projection.

In one example, a divider for an insulated storage container includes a temperature control pack, a first projection, and a second projection. The first projection is positioned on a first side of the divider and having a length having a first dimension and a width having a second dimension that is different than the first dimension. The second projection is positioned on a second side of the divider opposite the first side of the divider and has a length having the first dimension and a width having the second dimension. The first projection and the second projection are configured to be received in corresponding first pair of grooves in a cavity of an insulated container in a first orientation and a second pair of grooves in the cavity of the insulated container in the cavity of the insulated container in a second orientation, wherein the second orientation is substantially perpendicular to the first orientation.

In one example, a configurable storage container system for storing items includes an insulated divider having first and second projections, a tote, and an insulated shell with a lid. The tote has an internal cavity configured for storing the items. The internal cavity is at least partially bounded by a bottom and a plurality of walls. The first wall of the plurality of walls includes a first groove facing inward toward the internal cavity and is configured to receive the first projection of the insulated divider. The second wall of the plurality of walls includes a second groove also facing inward toward the internal cavity. The second groove is configured to receive the second projection of the insulated divider for dividing the internal cavity of the tote into two sections. The insulated shell is configured for receiving the tote. The insulated shell includes a base and a plurality of side walls and is foldable between an expanded configuration and a collapsed configuration such that the tote fits inside the insulated shell when the insulated shell is in the expanded configuration. The lid is configured for closing the tote inside the insulated shell when the insulated shell is in the expanded configuration. The storage container system may also include an ice pack configured to rest on the bottom of the internal cavity of the tote in one of the two sections.

Other variations and embodiments are possible, including variations and embodiments which do not necessarily include all of the elements described above and/or variations and embodiments which may include additional elements.

DETAILED DESCRIPTION

Figure 1:
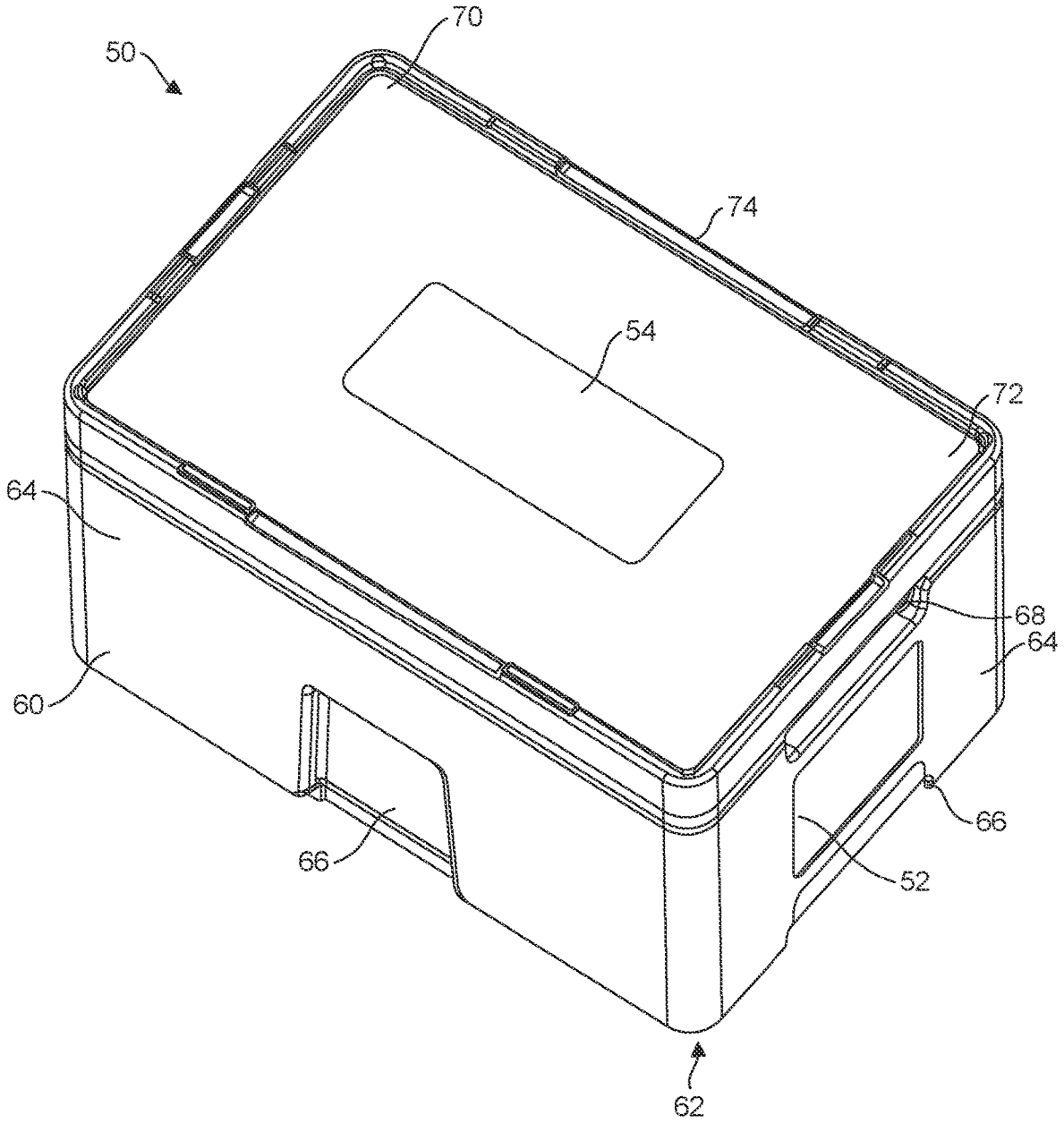
FIG. 1 illustrates an exemplary storage container.
Figure 2:
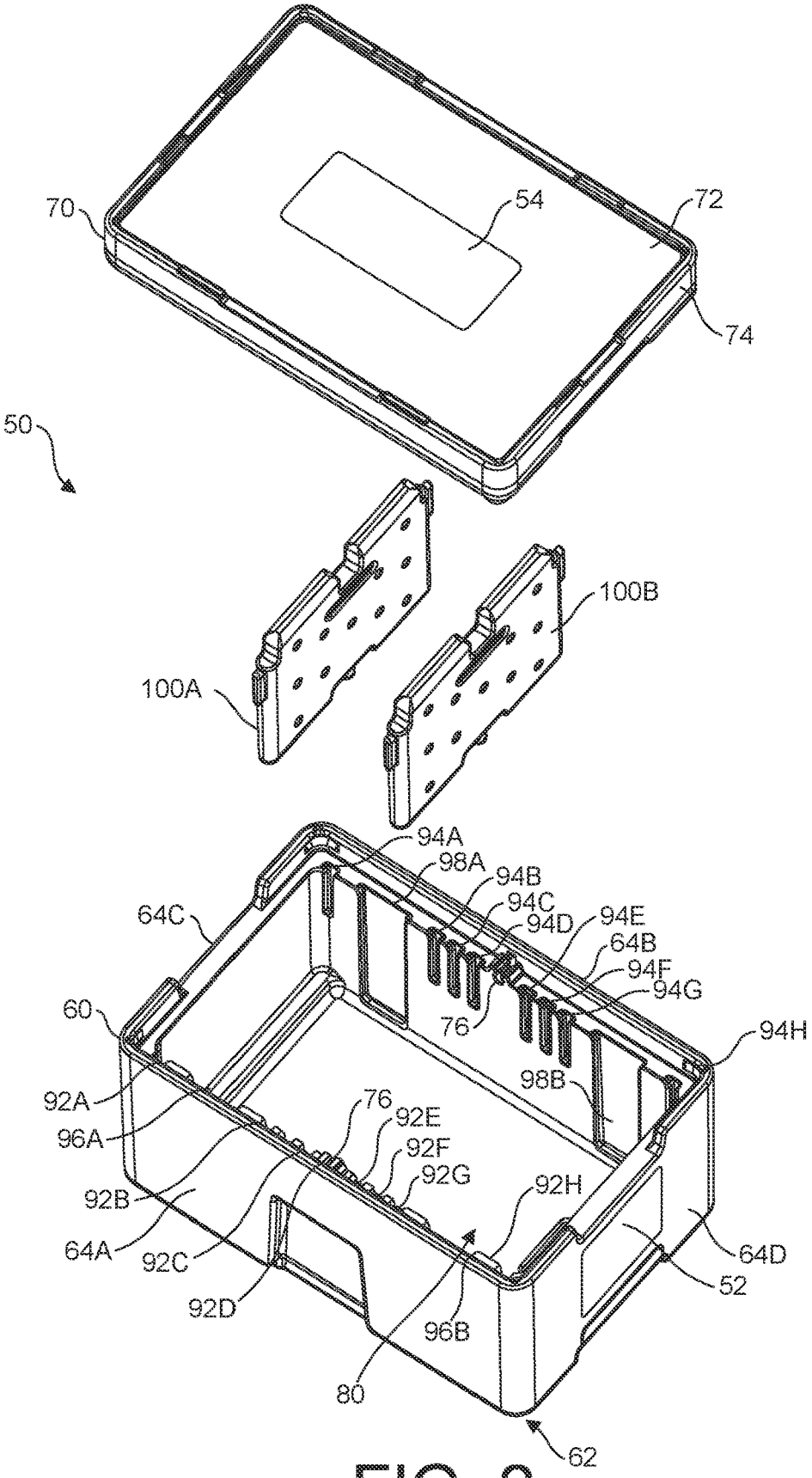
FIG. 2 illustrates an exploded view of the storage container of FIG. 1.
Figure 3:
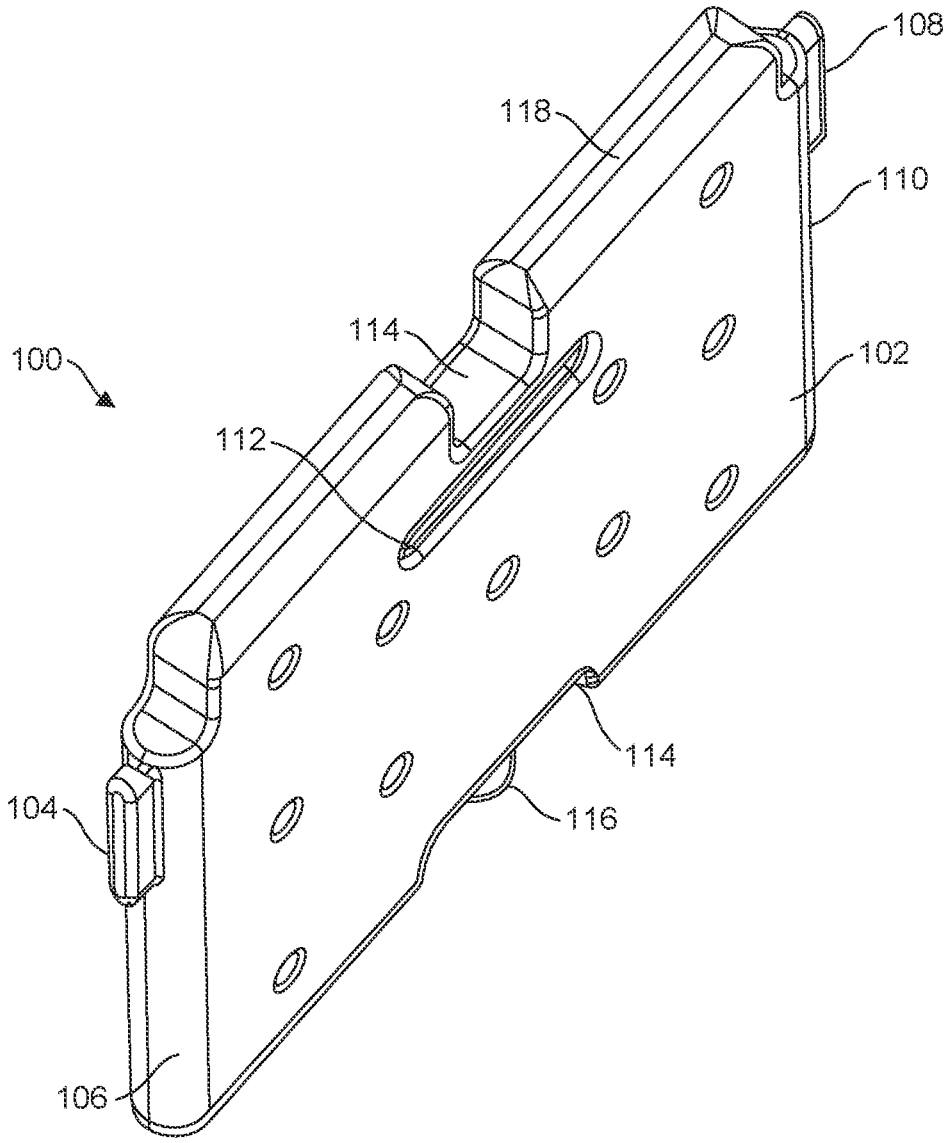
FIG. 3 illustrates an exemplary divider for use with the storage container of FIG. 1.
Figure 4:
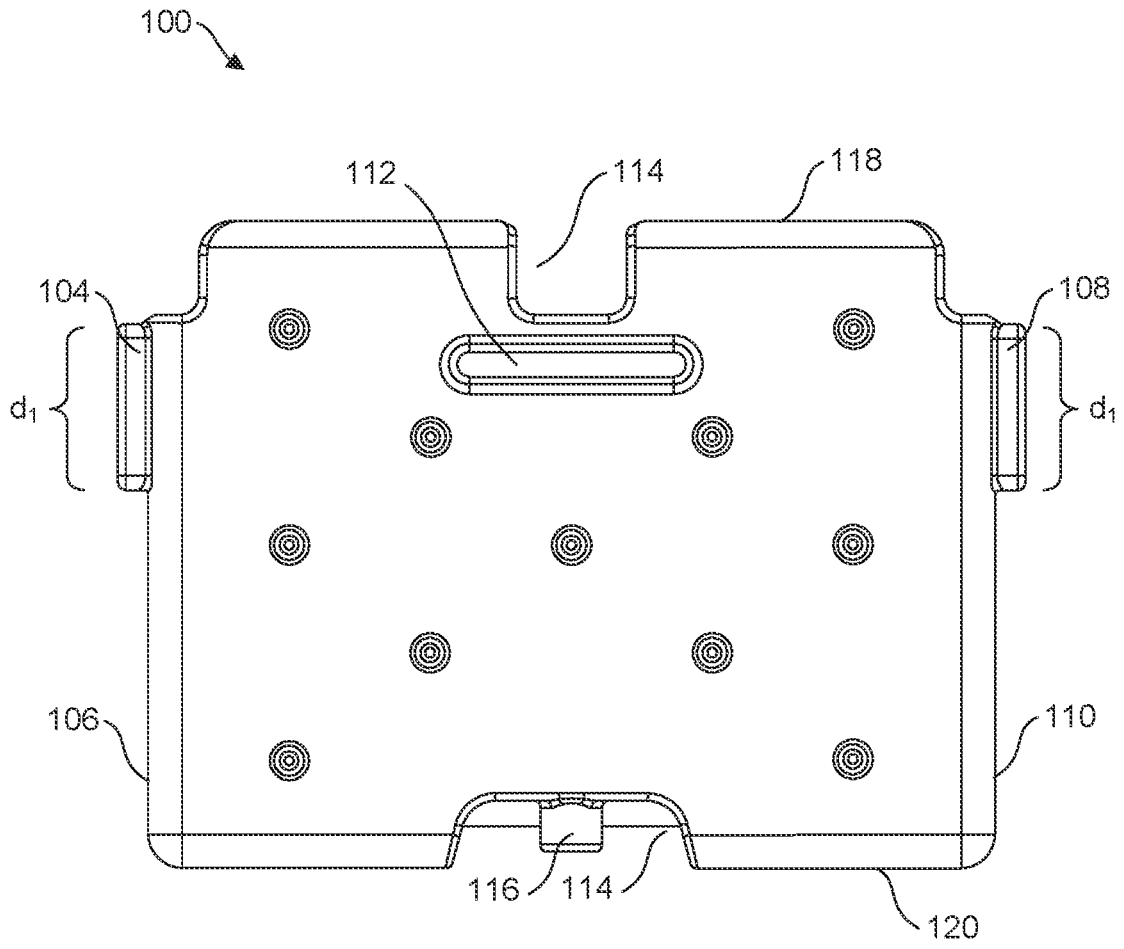
FIG. 4 illustrates a front view of the divider of FIG. 3.
Figure 5:
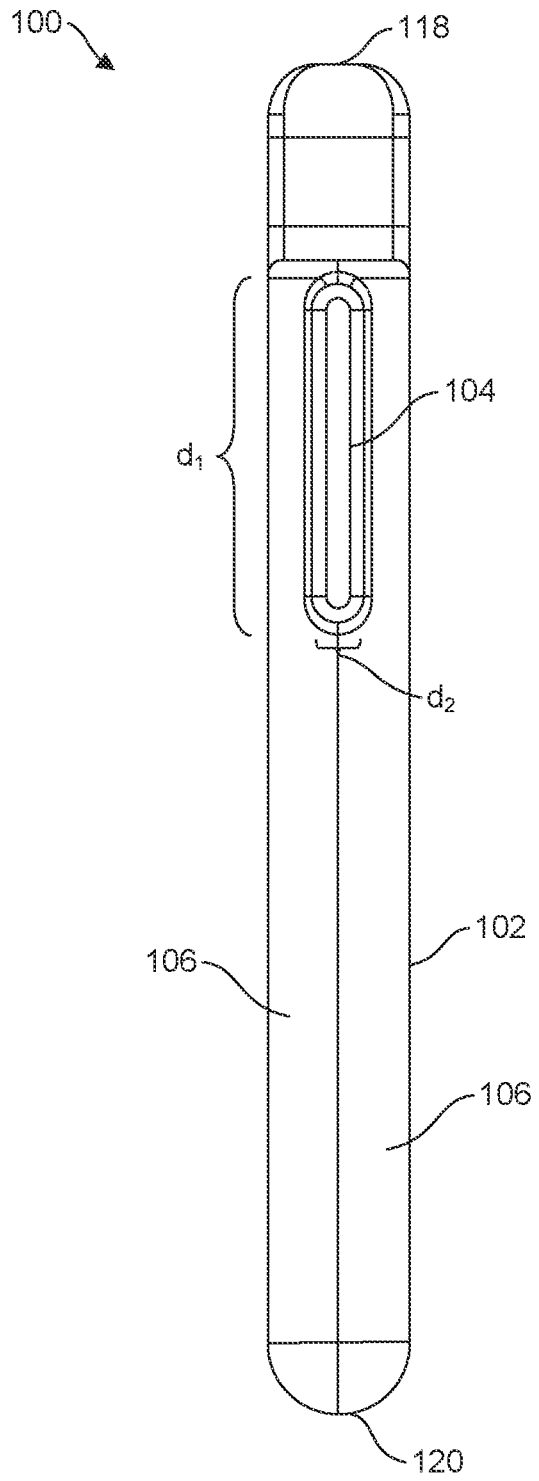
FIG. 5 illustrates a side view of the divider of FIG. 3.
Figure 6:
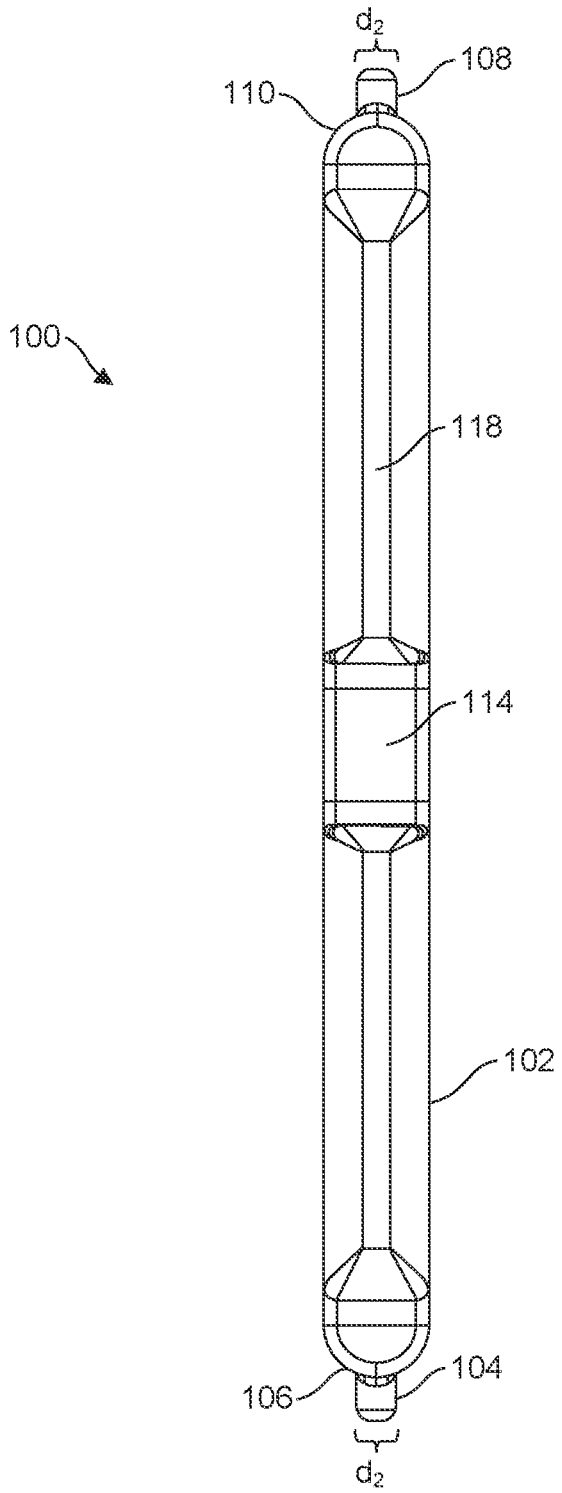
FIG. 6 illustrates a top view of the divider of FIG. 3.

FIGS. 1 and 2 illustrate an exemplary container 50 in accordance with the techniques and improvements disclosed herein. Container 50 includes a body 60 and a lid 70. Body 50 provides a cavity, storage compartment, storage volume, or storage area 80 which is accessible by removing lid 70 from body 60. Body 60 and/or lid 70 may be made from one or more plastics, food grade plastics, metals, and/or natural materials. Body 60 and/or lid 70 may be molded, injection molded, roto-molded, pressure-formed, 3-D printed, machined, and/or stamped. Each of body 60 and lid 70 may comprise a single component or may be made of multiple components. Each of body 60 and lid 70 may also include insulation or one or more insulating elements, such as foam, expanding foam, closed cell foam, structural foam, spray foam, blanket materials, one or more evacuated cavities, one or more vacuum panels, or combinations thereof. In some examples, one or more insulating elements or panels may also be replaceable, exchangeable, and/or swappable.

Body 60 and/or lid 70 may be rigid or may contain portions that are flexible, bendable, soft, compliant, stretchable, and/or compressible. In some cases, one or more portions of container 50 may be partially or fully collapsible when not in use. Various portions of container 50 may be attached to each other or to other items using one or more methods including sewing, gluing, adhesive, electro-welding, thermoplastic welding, co-molding, melting, and/or fasteners. Lid 70 may be fully removable from body 60 (as illustrated in FIG. 2) or may be attached to body 60 with a one or more hinges or hinging elements. Lid 70 may be removably held in a closed position against body 60 using one or more latches, clasps, fasteners, clips, and/or levers.

Body 60 and/or lid 70 also include one or more information panels, such as label receiver 52 or imprinted panel 54. Label receiver 52 may be a pouch, pocket, slot, recessed area, or surface for storing or displaying information about the contents of container 50 and/or shipping information for container 50. Label receiver 52 may include a substantially clear window or a substantially transparent window. The contents information and/or shipping information may be removable, changeable, or replaceable.

In some embodiments, container 50 and/or one or more parts of container 50 may be waterproof, water-resistant, abrasion resistant, tear resistant, and/or puncture resistant.

Body 60 includes a bottom 62 and a plurality of walls 64 extending upwardly from bottom 62 towards lid 70. In some embodiments, bottom 62, one or more walls 64, and/or lid 70 may include insulating elements. In the exemplary embodiment illustrated in FIG. 2, body 60 includes 4 walls, including opposing first and second side walls 64A, 64B and opposing first and second end walls 64C, 64D. In other embodiments, body 60 may include more or fewer walls 64 than illustrated in FIG. 2. Although illustrated as generally rectangular in shape, in other embodiments, body 60 may have any other suitable shape, such as circular, oval, triangular, square, or as a regular or irregular polygon having 4 or more sides.

Container 50 illustratively includes one or more handles 66 for carrying container 50 or a portion of container 50, such as body 60. Although illustrated as a portion of body 60, in other embodiments, handles 66 may be formed as a portion of lid 70, or formed between body 60 and lid 70, such as handles 68. In other examples, handles 66 may be separate components which are attached and/or removable.

Lid 70 illustratively includes a top surface 72 and a perimeter portion 74 that interfaces with side walls 64 to close off internal cavity 80. In some embodiments, lid 70 is releasably affixed to body 50 with one or more latches or clasps 76. Clasps 76 may provide a closure that is waterproof, water-resistant, childproof, child resistant, animal proof, and/or animal resistant. Clasps 76 may include one or more components made of plastic, metal, wood, ceramic, rubber, and/or silicone. Further, clasps 76 may include a locking mechanism or may include an interface for use with one or more locks or access control devices, such as an electronic lock or a seal which indicates opening or tampering. One or more gaskets or seals (not illustrated in FIG. 2) may also be used between lid 70 and body 60.

Container 50 may also include one or more attachment areas or attachment points for removably attaching one or more accessories or other items to container 50. Attachment points may include any of a variety of attachment mechanisms, structures, elements, or features including any described in U.S. patent application Ser. No. 15/398,468, filed Jan. 4, 2017, which is hereby incorporated by reference in its entirety.

Body 60 illustratively includes a plurality of grooves 92, 94, 96, 98 configured to receive one or more dividers 100.

In the embodiments illustrated in FIG. 2, first side wall 64A includes a first plurality of grooves 92A-92H, each groove 92 of the plurality of grooves 92A-92H is configured or adapted to receive a divider 100, such as divider 100A or divider 100B in a first vertical orientation (see FIG. 12) at a different position within internal cavity 80. FIG. 2 further illustrates second side wall 64B as including a second plurality of grooves 94A-94H, each groove 94 of the plurality of grooves 94A-94H positioned across from a corresponding groove 92 of the first plurality of grooves 92A-94H and configured to receive a divider 100, such as divider 100A or divider 100B in a first vertical orientation at a different position within internal cavity 80. In other embodiments, divider 100 is received only by a groove of either the first plurality of grooves 92A-92H or the second plurality of grooves 94A-94H in the first vertical orientation, but not both.

In the embodiments illustrated in FIG. 2, first side wall 64A also includes a third plurality of grooves 96A, 96B, each groove 96 of the plurality of grooves 96A, 96B is configured or adapted to receive a divider 100, such as divider 100A or divider 100B in a second horizontal orientation (see FIG. 15) at a different position within internal cavity 80. FIG. 2 further illustrates second side wall 64B as including a second fourth of grooves 98A, 98B, each groove 98 of the plurality of grooves 98A, 98B positioned across from a corresponding groove 96 of the third plurality of grooves 96A, 96B and is configured to receive a divider 100, such as divider 100A or divider 100B in a second horizontal orientation at a different position within internal cavity 80. In other embodiments, divider 100 is received only by a groove of either the third plurality of grooves 96A, 96B or the second plurality of grooves 98A, 98B in the second horizontal orientation, but not both.

Referring next to FIGS. 3-6, an exemplary divider 100 is illustrated. Divider 100 is removably insertable into internal cavity 80 of body 60. In some embodiments, divider 100 is moveable between a vertical orientation (see FIG. 12) and a horizontal orientation (see FIG. 15). In some vertical orientations, divider 100 may divide internal cavity 80 into one or more sections.

In some exemplary embodiments, divider 100 is a temperature control pack, such as an ice pack, liquid cold pack, gel pack, instant ice pack, ice, dry ice, hot pack, temperature maintenance device, and/or other thermal item for maintaining or controlling a temperature in internal cavity 80 of container 50. In other embodiments, divider 100 is not a temperature control pack.

Divider 100 includes a divider body 102. In some exemplary embodiments, divider body 102 may be at least partially filled with a temperature control medium, thermal material, or phase change material.

Divider 100 includes a first projection 104 positioned on a first side 106 of divider body 102. First projection 104 has a length indicated by $d_1$ (see FIGS. 4-5) and a width indicated by $d_2$ (see FIGS. 5-6). Divider 100 further includes a second projection 108 positioned on a second side 110 of divider body 102. In the illustrated embodiment, second projection 108 has the same length $d_1$ and same width $d_2$ as first projection 104. In other embodiments, the length and/or width of second projection 108 is different than the corresponding length and/or width of first projection 104.

Figure 12:
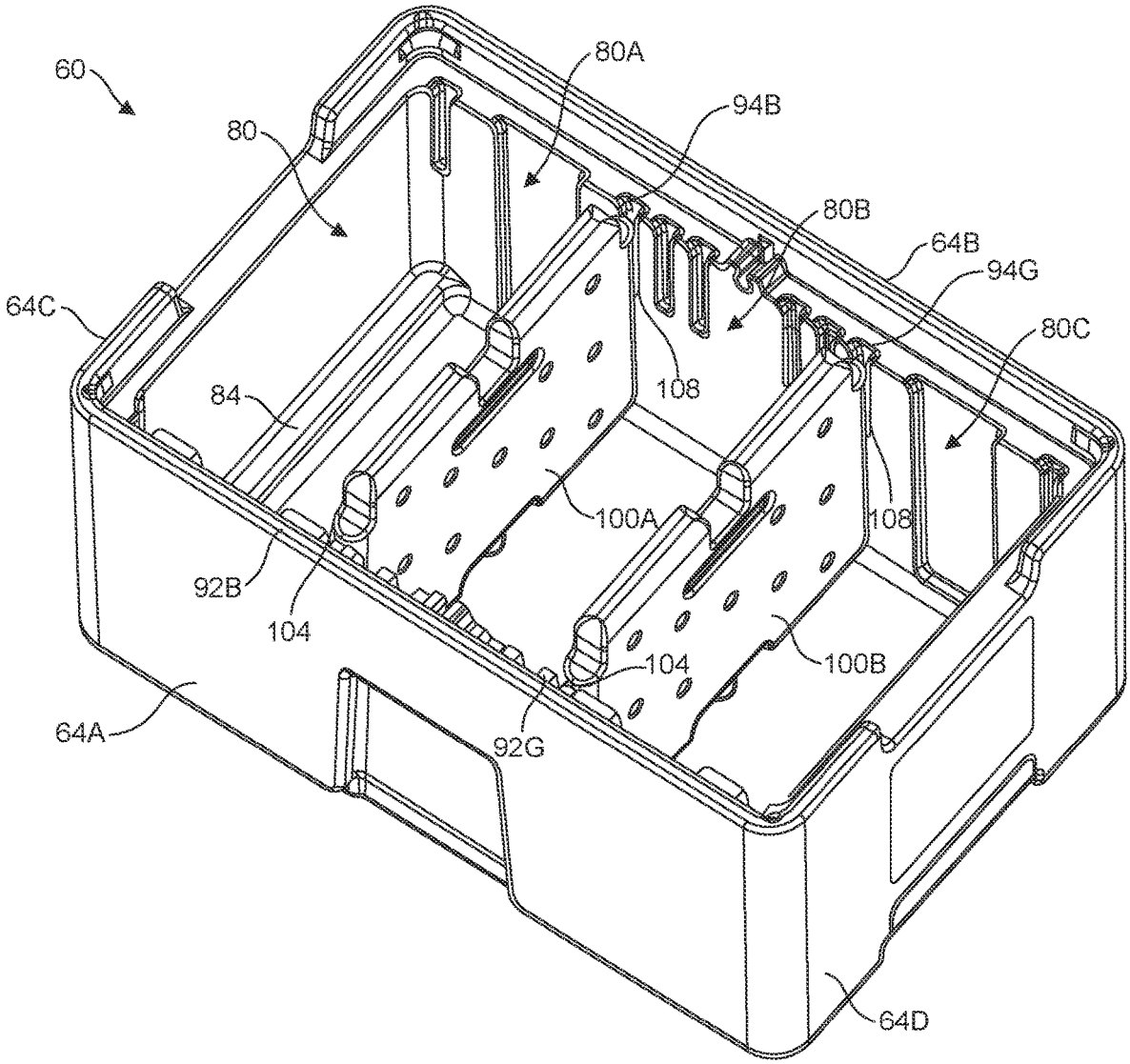
FIG. 12 illustrates the body of FIG. 7 with dividers in a second exemplary configuration.

In some embodiments, first projection 104 and second projection 108 are configured such that the width $d_2$ dimension of each is releasably received within one of the corresponding first plurality of grooves 92A-92H and second plurality of grooves 96A-96H to position the divider 100 in the first vertical orientation (see FIG. 12).

Figure 15:
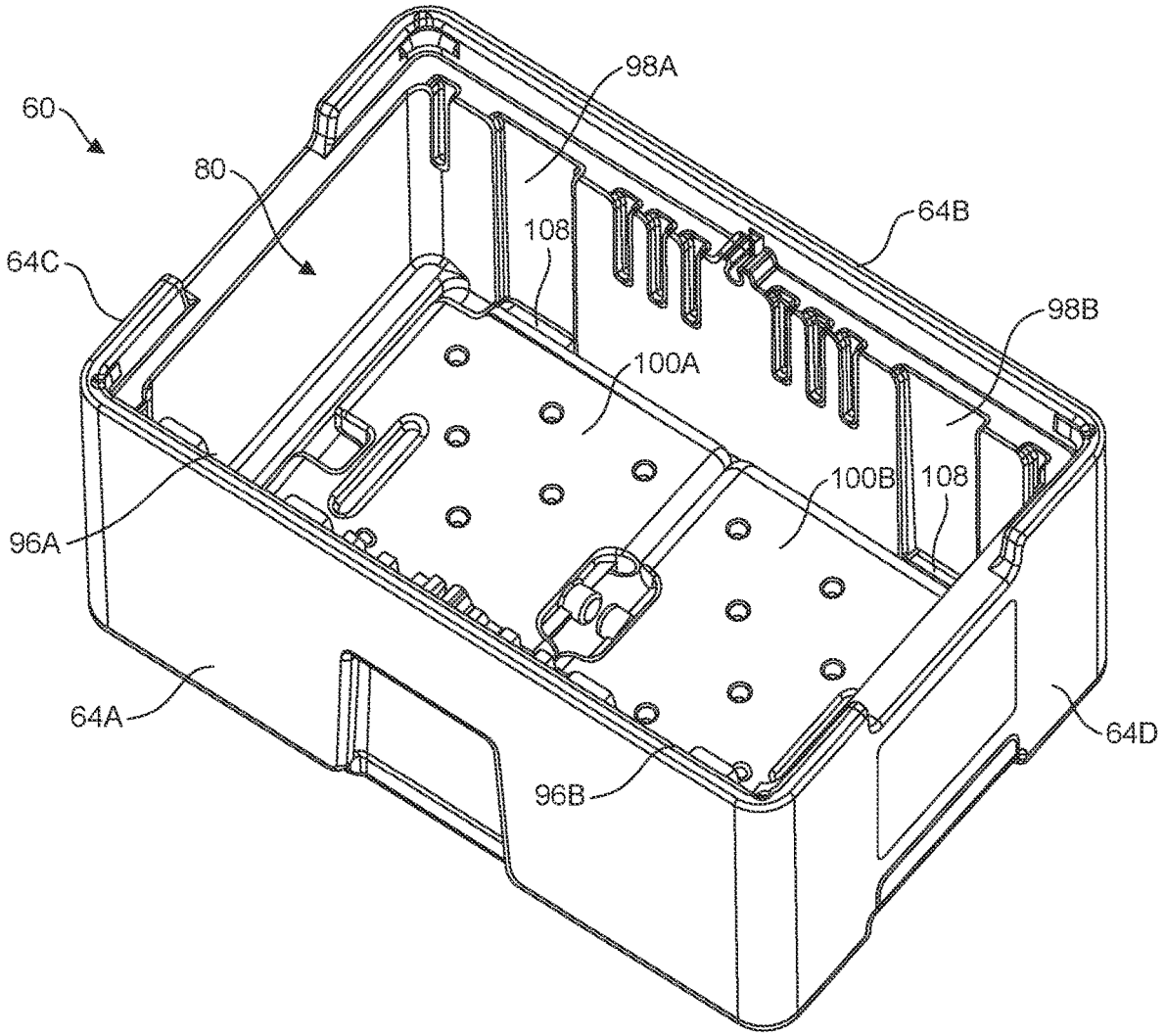
FIG. 15 illustrates the body of FIG. 7 with dividers in a fifth exemplary configuration.

In some embodiments, first projection 104 and second projection 108 are configured such that the width $d_1$ dimension of each is releasably received within one of the corresponding third plurality of grooves 96A, 96B and second plurality of grooves 98A, 98B to position the divider 100 in the first horizontal orientation (see FIG. 15).

In the illustrated embodiment, the length dimension $d_1$ of the first and second projections 104, 108 is larger than the width dimension $d_2$ of the first and second projections 104, 108, and the corresponding second and fourth plurality of grooves 96, 98 are larger than the first and third plurality of grooves 92, 94. In other embodiments, the length dimension $d_1$ of the first and second projections 104, 108 is smaller than the width dimension $d_2$ of the first and second projections 104, 108, and the corresponding second and fourth plurality of grooves 96, 98 are smaller than the first and third plurality of grooves 92, 94. In still other embodiments, the length dimension $d_1$ of the first and second projections 104, 108 is the same as than the width dimension $d_2$ of the first and second projections 104, 108, and the corresponding second and fourth plurality of grooves 96, 98 are the same as the first and third plurality of grooves 92, 94.

Referring again to FIGS. 3 and 4, in some embodiments, divider 100 includes a handle 112 or grip area to assist a user in inserting and/or removing divider 100 from the interior cavity 80 of container 50.

In some embodiments, divider 100 includes one or more ventilation openings 114 to allow air to be exchanged between adjacent portions of internal cavity 80 divided by divider 100.

In some embodiments divider body 102 may be fillable with a liquid phase change material, such as water. The divider body 102 may include one or more nozzles 116 to assist in filling the interior of divider body 102 and/or one or more valves for releasing pressure.

Divider 100 includes an upper surface 118. In some embodiments, upper surface 118 contacts lid 70 of container 50 when divider 100 is in the first vertical orientation. Divider 100 further includes a lower surface 120. In some embodiments, upper surface 118 contacts a bottom interior surface, such as surface 82 or raised bottom surface 84 (see FIG. 9) of body 60 when divider 100 is in the first vertical orientation.

Figure 7:
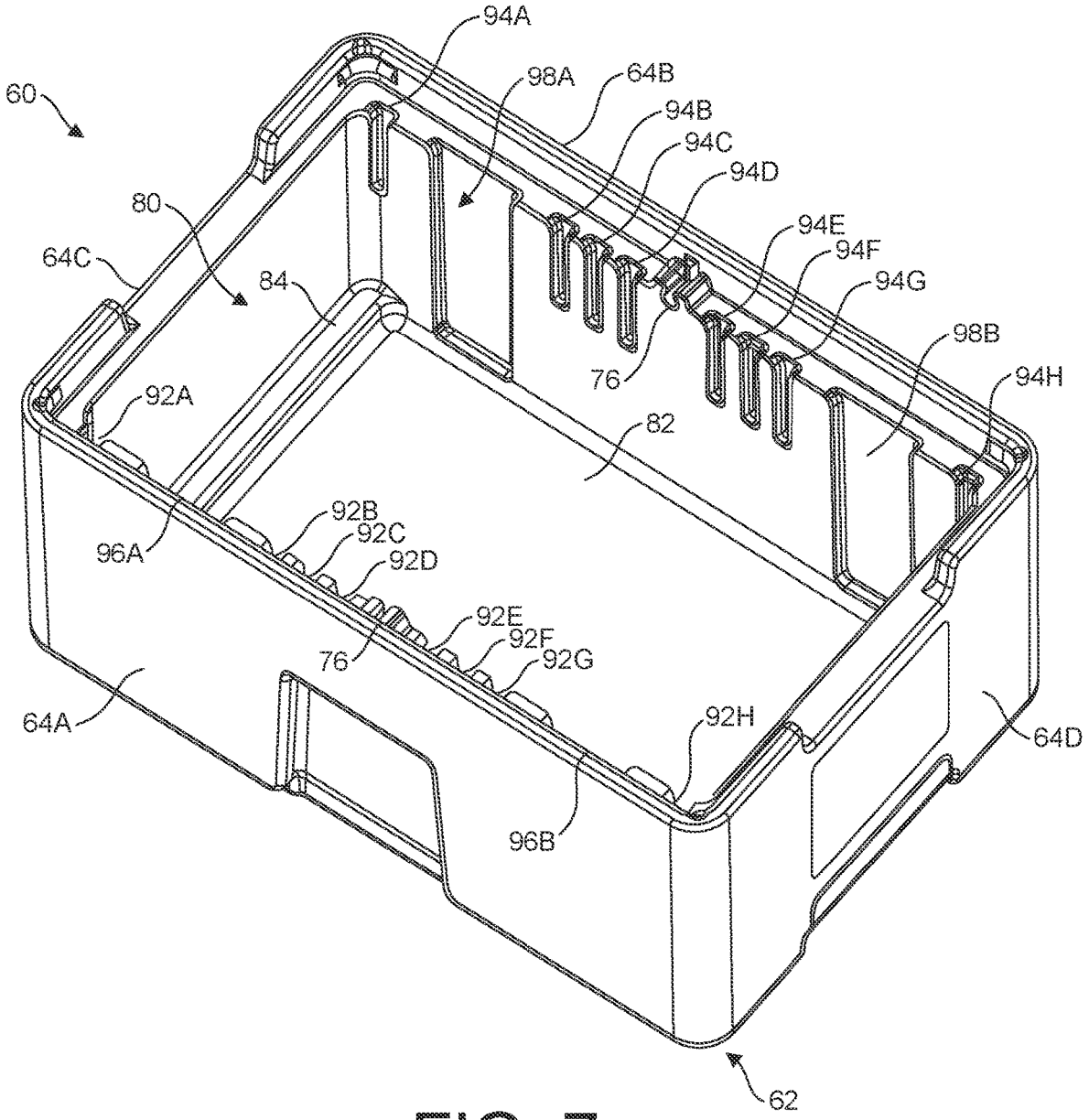
FIG. 7 illustrates an empty exemplary body of the storage container of FIG. 1.
Figure 8:
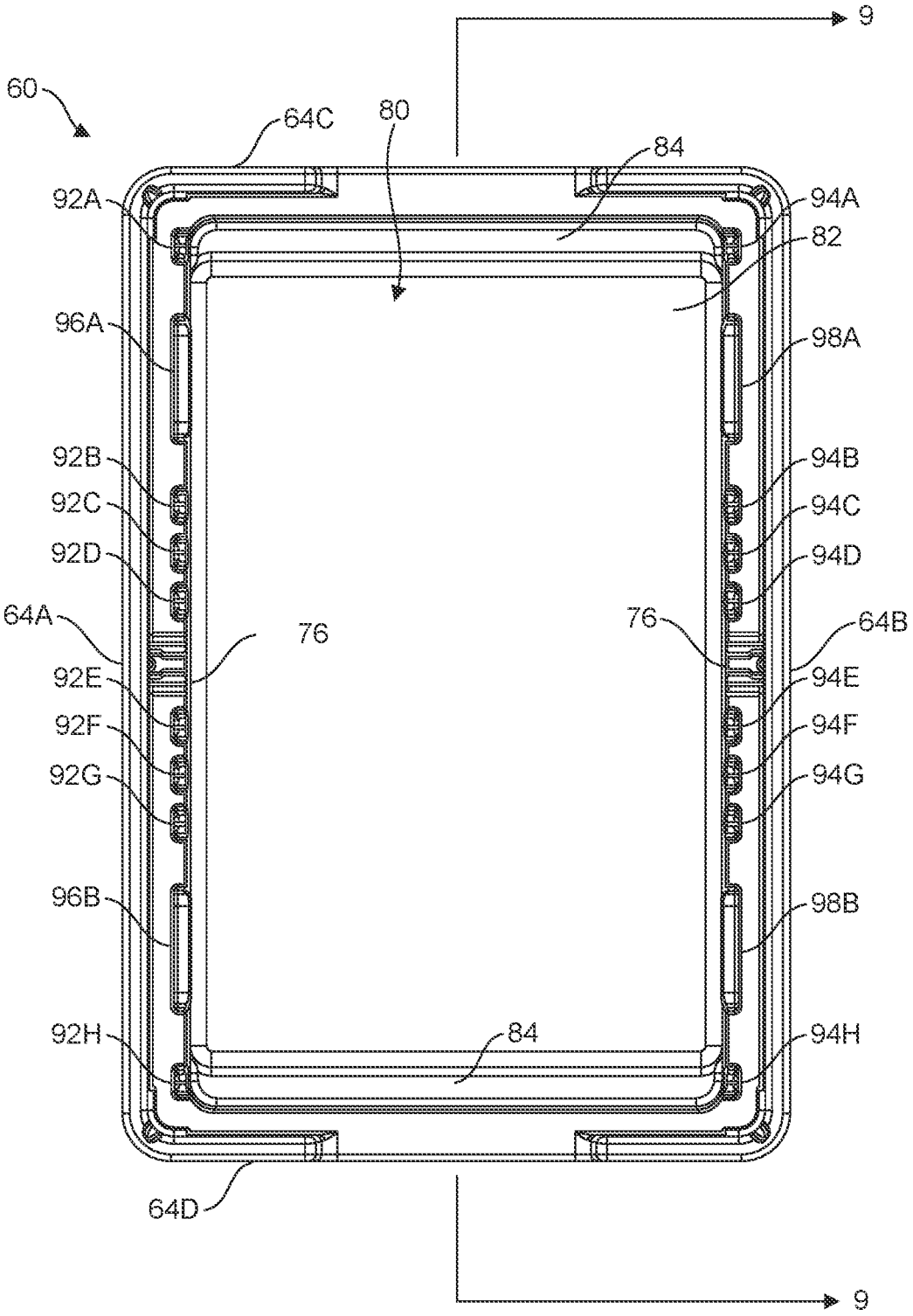
FIG. 8 illustrates a top view of the body of FIG. 7.
Figure 9:
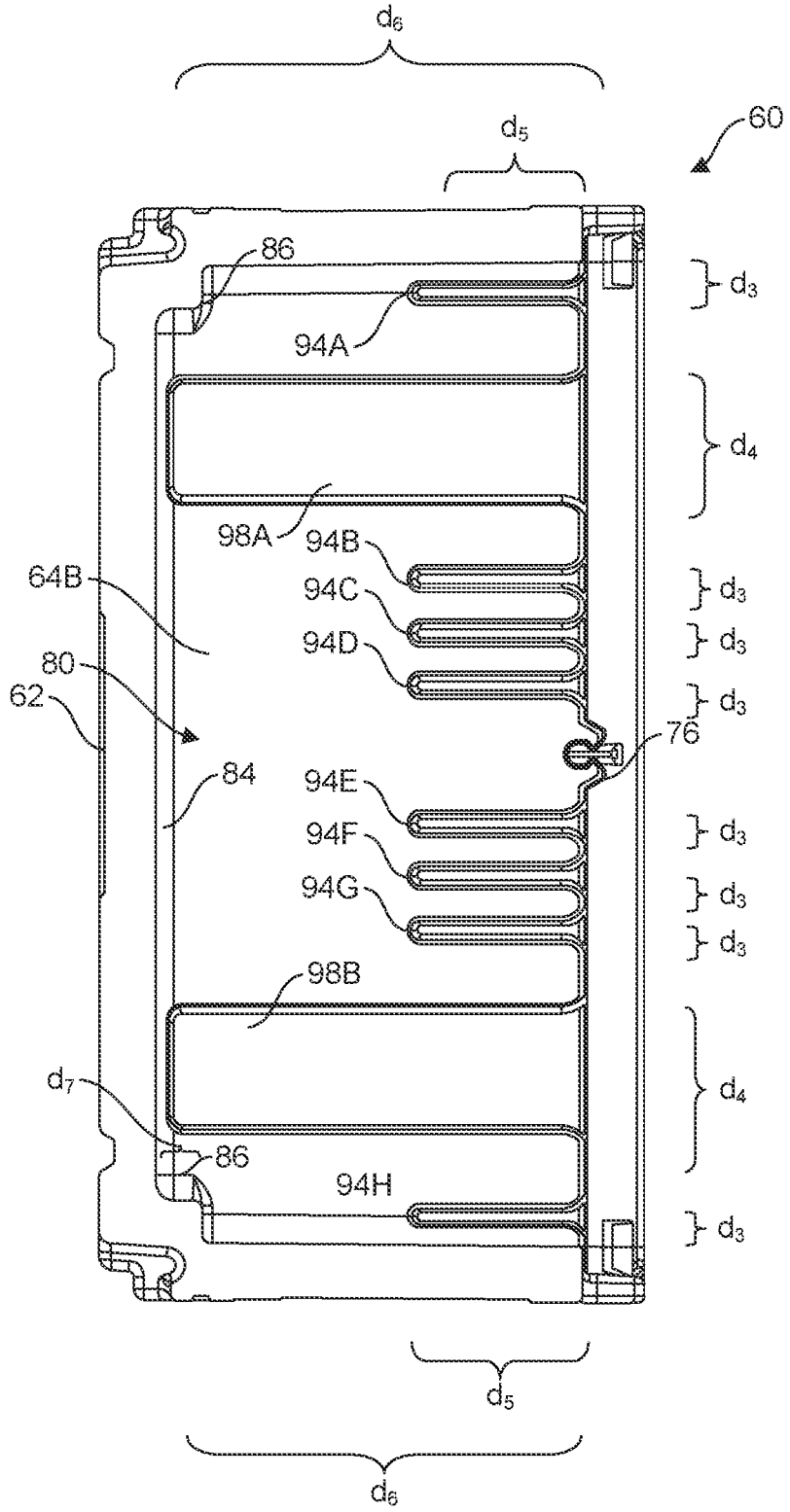
FIG. 9 illustrates a sectional view along the line 9-9 in FIG. 8.

Referring next to FIGS. 7-9, an empty body 60 of container 50 is illustrated.

In the embodiment illustrated in FIGS. 7-9, each groove 94A-94H has a width $d_3$ (see FIG. 9). Width $d_3$ is configured to receive the width dimension $d_2$ of either first projection 104 or second projection 108 when divider 100 is in the first vertical orientation. The width $d_3$ of each groove 94A-94H is further configured to be too small to receive the length dimension $d_1$ of either first projection 104 or second projection 108 when divider 100 is in the second horizontal orientation.

In the embodiment illustrated in FIGS. 7-9, each groove 98A, 98B has a width $d_4$. Width $d_4$ is configured to receive the length dimension $d_1$ of either first projection 104 or second projection 108 when divider 100 is in the second horizontal orientation. The width $d_4$ of each groove 98A, 98B is further configured to be too large to securely receive the width dimension $d_2$ of either first projection 104 or second projection 108 when divider 100 is in the first vertical orientation.

In the embodiment illustrated in FIGS. 7-9, each groove 94A-94H has a length $d_5$. Length $d_5$ is configured to be long enough to receive the length dimension $d_1$ of either first projection 104 or second projection 108 when divider 100 is in the first vertical orientation. In some embodiments, the length $d_5$ of each groove 94A-94H is further configured such that the lower surface 120 of divider 100 rests on the interior bottom surface 82, or raised bottom surface 84 of body 60 when the divider 100 is fully inserted into the groove 94A-94H. In some embodiments, the length $d_5$ of each groove 94A-94H is further configured such that the lower surface 120 of divider 100 is a predetermined distance $d_7$ above the interior bottom surface 82, or raised bottom surface 84 of body 60 when the divider 100 is fully inserted into the groove 94A-94H. In some embodiments, distance $d_7$ is large enough to position a second divider 100 between the lower surface 120 of the first divider 100 and interior surface 82 of body 60 (see FIG. 11).

In the embodiment illustrated in FIGS. 7-9, each groove 98A, 98B has a length $d_6$. Length $d_6$ is configured to allow divider 100 to be support by interior surface 82 when divider 100 is positioned in the second horizontal orientation.

Interior cavity 80 has a bottom surface 82. In some exemplary embodiments, the lower surface 120 of divider 100 contacts bottom surface 82 when divider 100 is in the first vertical orientation. In some exemplary embodiments, the divider body 102 contacts bottom surface 82 when the divider 100 is in the second horizontal orientation. As illustrated in FIG. 9, in some embodiments, a portion of bottom surface 82 proximate end walls 64C, 64D is raised, forming raised bottom surface 84. In some exemplary embodiments, the lower surface 120 of divider 100 contacts raised bottom surface 84 when divider 100 is in the first vertical orientation.

Figure 10:
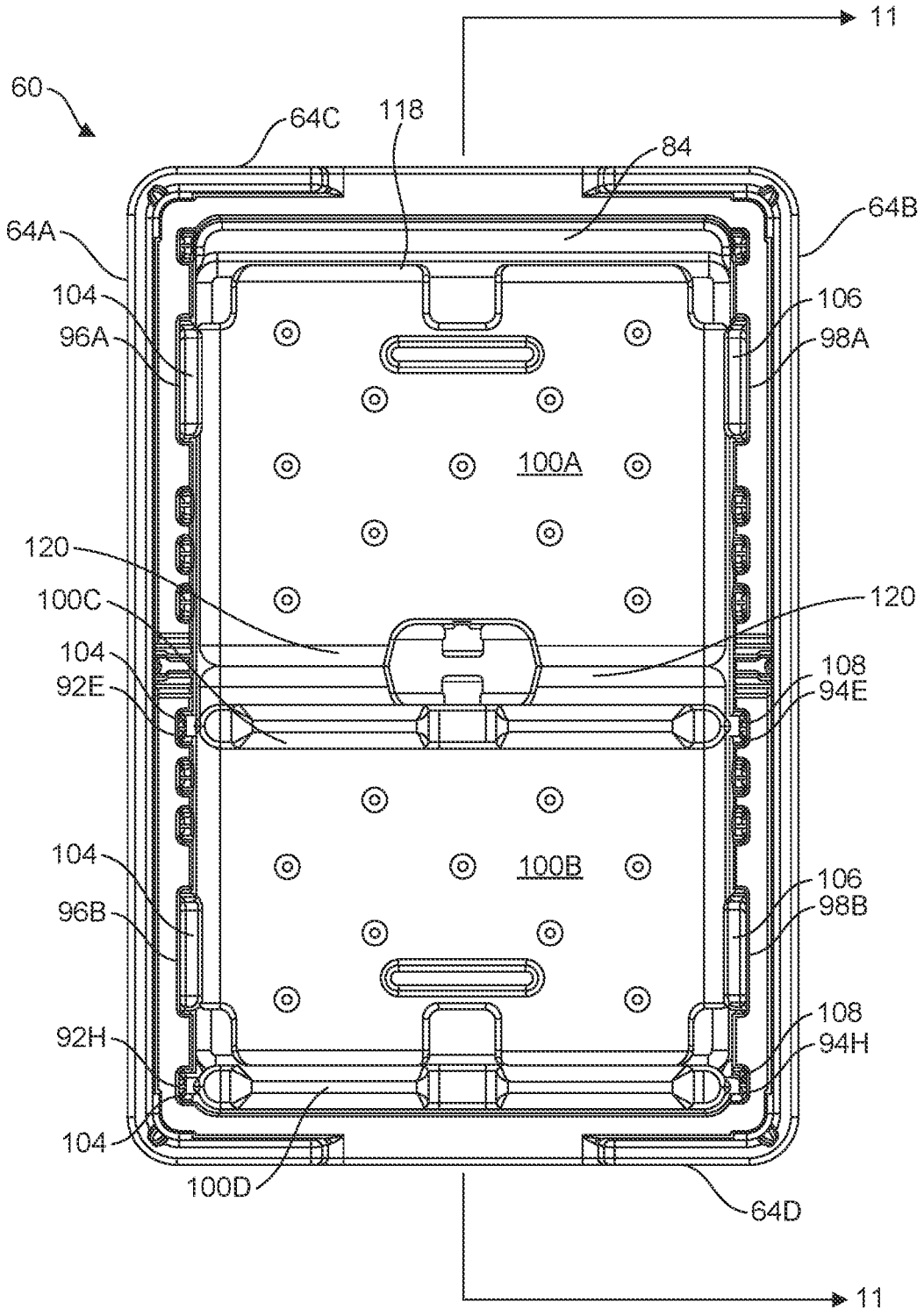
FIG. 10 illustrates a top view of the body of FIG. 7 with dividers in a first exemplary configuration.
Figure 11:
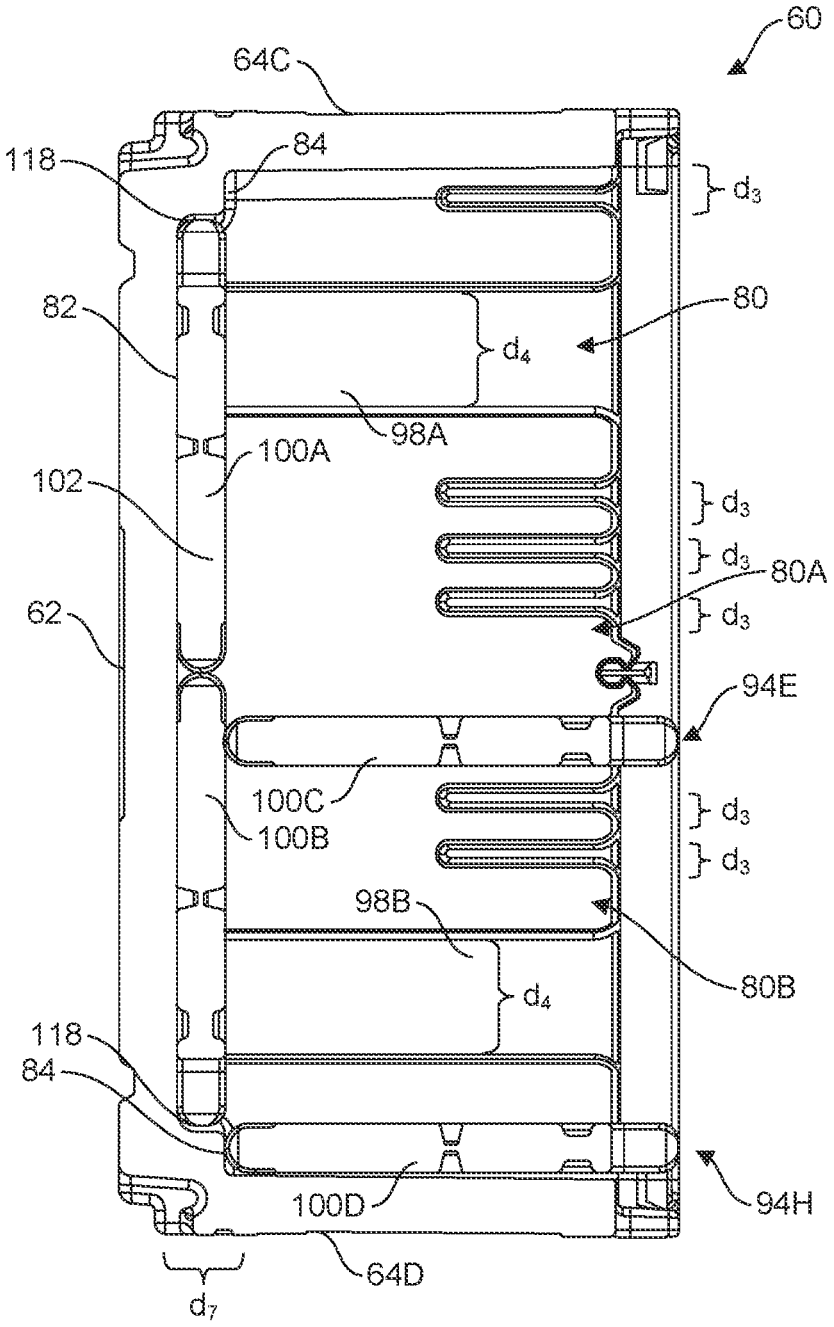
FIG. 11 illustrates a sectional view along the line 11-11 in FIG. 10.

Referring next to FIGS. 10 and 11, body 60 is illustrated with four dividers 100, labeled as first divider 100A, second divider 100B, third divider 100C, and fourth divider 100D. Those of skill in the art will recognize that in other embodiments, more or fewer dividers 100 may be provided and/or inserted. Additionally, while each divider 100A-100D is identical to each other in the illustrated embodiment, in other embodiments, one or more dividers 100 provided may be different than one or more other provided dividers 100. The dividers may differ dimensionally, thermally, or both.

In FIG. 10, first divider 100A is illustratively positioned in the second horizontal orientation. The first projection 104 of first divider 100A is received within groove 96A of first side wall 64A and the second projection 108 of first divider 100A is received within corresponding groove 98A of second side wall 64B. First divider 100A is positioned such that the upper surface 118 is adjacent to raised bottom surface 84, and the divider body 102 is supported by bottom interior surface 82.

Second divider 100B is also illustratively positioned in the second horizontal orientation. The first projection 104 of second divider 100B is received within groove 96B of first side wall 64A and the second projection 108 of second divider 100B is received within corresponding groove 98B of second side wall 64B. Second divider 100B is positioned such that the upper surface 118 is adjacent to raised bottom surface 84, and the divider body 102 is supported by bottom interior surface 82. The lower surface 120 of second divider 100B is positioned adjacent to the lower surface 120 of first divider 100A.

Third divider 100C is illustratively positioned in the first vertical orientation, dividing interior cavity 80 into a first portion 80A and a second portion 80B. The first projection 104 of third divider 100C is received within groove 92E of first side wall 64A and the second projection 108 of third divider 100C is received within corresponding groove 96E of second side wall 64B. The upper surface 118 of third divider 100C is positioned to allow lid 70 to attach to body 60 of container 50. The lower surface 120 of third divider 100C is supported by grooves 92E, 96E a distance $d_7$ (see FIG. 9) above bottom interior surface 82 to allow second divider 100B to be positioned below third divider 100C.

Fourth divider 100D is also illustratively positioned in the first vertical orientation. Fourth divider 100C is illustratively positioned against an interior surface of end wall 64D. The first projection 104 of fourth divider 100D is received within groove 92H of first side wall 64A and the second projection 108 of fourth divider 100D is received within corresponding groove 96H of second side wall 64B. The upper surface 118 of fourth divider 100D is positioned even with the upper surface 118 of third divider 100C to allow lid 70 to attach to body 60 of container 50. The lower surface 120 of fourth divider 100D is supported by grooves 92H, 96H proximate the raised interior surface 84 proximate end wall 64D.

Referring next to FIG. 12, an exemplary body 60 is illustrated with two dividers 100, labeled as first divider 100A, and second divider 100B, dividing interior cavity 80 between a first portion 80A, a second portion 80B, and a third portion 80C.

First divider 100A is illustratively positioned in the first vertical orientation, dividing interior cavity 80 between first portion 80A and second portion 80B. The first projection 104 of first divider 100A is received within groove 92B of first side wall 64A and the second projection 108 of first divider 100A is received within corresponding groove 94B of second side wall 64B. The lower surface 120 of first divider 100A is supported by grooves 92B, 94B a distance $d_7$ (see FIG. 9) above bottom interior surface 82.

Second divider 100B is illustratively positioned in the first vertical orientation, dividing interior cavity 80 between second portion 80B and third portion 80C. The first projection 104 of second divider 100B is received within groove 92G of first side wall 64A and the second projection 108 of second divider 100B is received within corresponding groove 94G of second side wall 64B. The lower surface 120 of second divider 100B is supported by grooves 92G, 94G a distance $d_7$ (see FIG. 9) above bottom interior surface 82.

Figure 13:
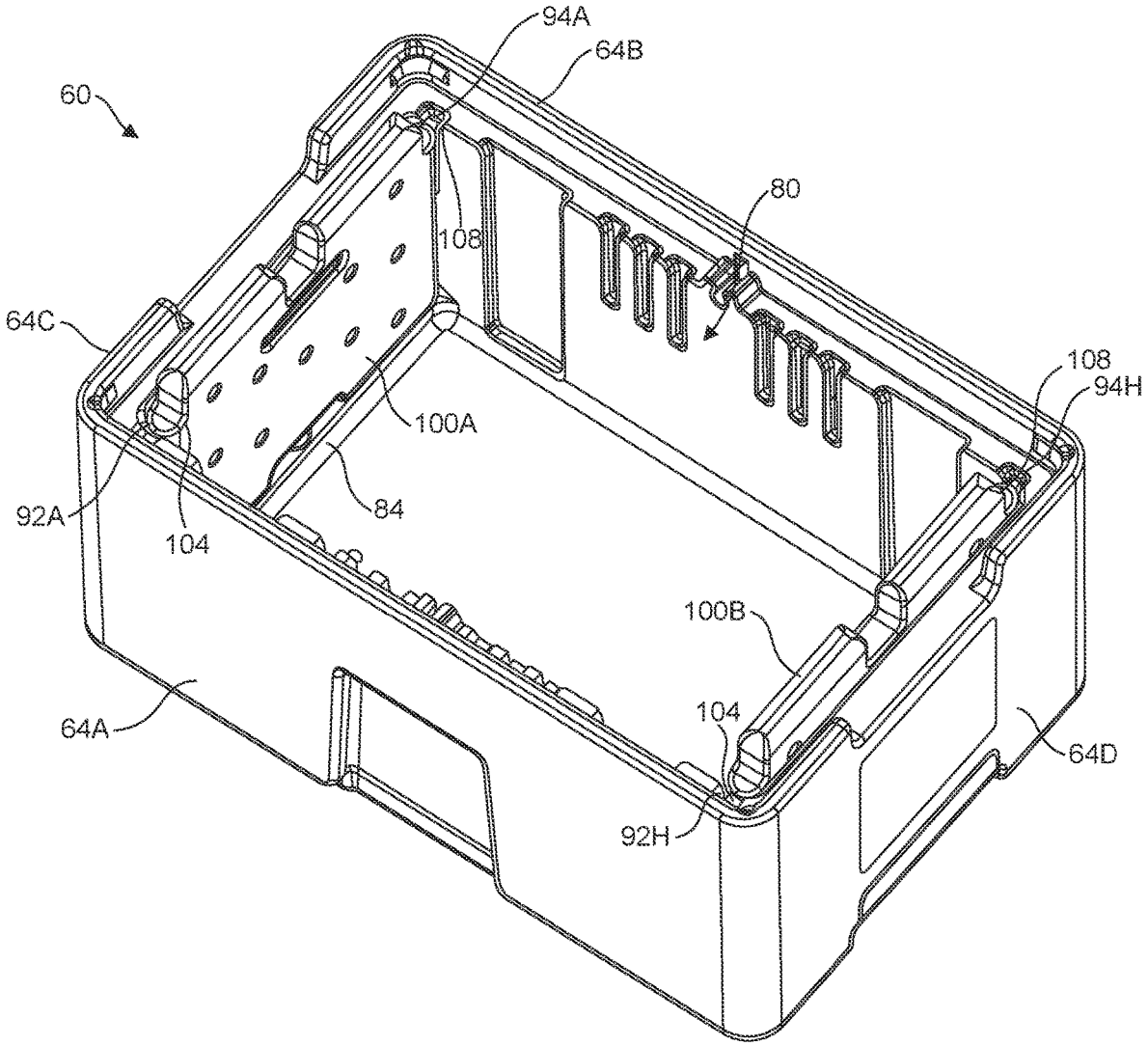
FIG. 13 illustrates the body of FIG. 7 with dividers in a third exemplary configuration.

Referring next to FIG. 13, an exemplary body 60 is illustrated with two dividers 100, labeled as first divider 100A, and second divider 100B, positioned at either end of interior cavity 80.

First divider 100A is illustratively positioned in the first vertical orientation against first end wall 64C. The first projection 104 of first divider 100A is received within groove 92A of first side wall 64A and the second projection 108 of first divider 100A is received within corresponding groove 94A of second side wall 64B. The lower surface 120 of first divider 100A contacts the raised bottom surface 84.

Second divider 100B is illustratively positioned in the second vertical orientation against second end wall 64D. The first projection 104 of second divider 100B is received within groove 92H of first side wall 64A and the second projection 108 of second divider 100B is received within corresponding groove 94H of second side wall 64B. The lower surface 120 of second divider 100B contacts the raised bottom surface 84.

Figure 14:
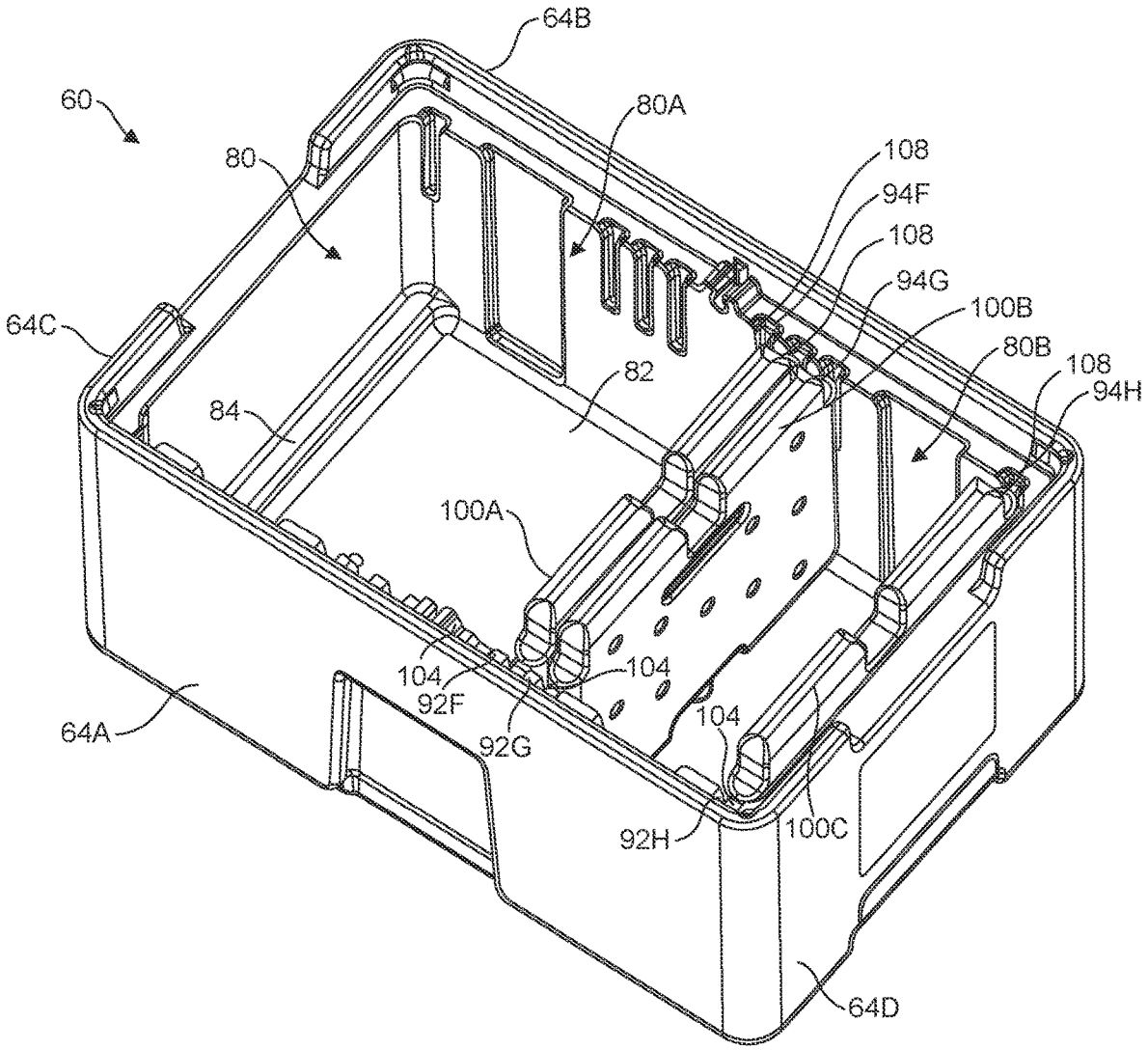
FIG. 14 illustrates the body of FIG. 7 with dividers in a fourth exemplary configuration.

Referring next to FIG. 14, an exemplary body 60 is illustrated with three dividers 100, labeled as first divider 100A, second divider 100B, and third divider 100C. First divider 100A and second divider 100B divide interior cavity 80 into a first portion 80A and a second portion 80B, while third divider 100C is positioned at an end of second portion 80B proximate end wall 64D.

First divider 100A is illustratively positioned in the first vertical orientation, dividing interior cavity 80 with second divider 100B between first portion 80A and second portion 80B. The first projection 104 of first divider 100A is received within groove 92F of first side wall 64A and the second projection 108 of first divider 100A is received within corresponding groove 94F of second side wall 64B. The lower surface 120 of first divider 100A is supported by grooves 92F, 94F a distance $d_7$ (see FIG. 9) above bottom interior surface 82.

Second divider 100B is illustratively positioned in the first vertical orientation, dividing interior cavity 80 with first divider 100A between first portion 80A and second portion 80B. The first projection 104 of second divider 100B is received within groove 92G of first side wall 64A and the second projection 108 of second divider 100B is received within corresponding groove 94G of second side wall 64B. The lower surface 120 of second divider 100B is supported by grooves 92G, 94G a distance $d_7$ (see FIG. 9) above bottom interior surface 82.

Third divider 100C is illustratively positioned in the second vertical orientation against second end wall 64D. The first projection 104 of third divider 100C is received within groove 92H of first side wall 64A and the second projection 108 of third divider 100C is received within corresponding groove 94H of second side wall 64B. The lower surface 120 of third divider 100C contacts the raised bottom surface 84.

Referring next to FIG. 15, an exemplary body 60 is illustrated with two dividers 100, labeled as first divider 100A and second divider 100B.

First divider 100A is illustratively positioned in the second horizontal orientation. The first projection 104 of first divider 100A is received within groove 96A of first side wall 64A and the second projection 108 of first divider 100A is received within corresponding groove 98A of second side wall 64B. First divider 100A is positioned such that the upper surface 118 is adjacent to raised bottom surface 84, lower surface 120 is adjacent to second divider 100B, and the divider body 102 is supported by bottom interior surface 82.

Second divider 100B is also illustratively positioned in the second horizontal orientation. The first projection 104 of second divider 100B is received within groove 96B of first side wall 64A and the second projection 108 of second divider 100B is received within corresponding groove 98B of second side wall 64B. Second divider 100B is positioned such that the upper surface 118 is adjacent to raised bottom surface 84, lower surface 120 is adjacent to first divider 100A, and the divider body 102 is supported by bottom interior surface 82.

Figure 16:
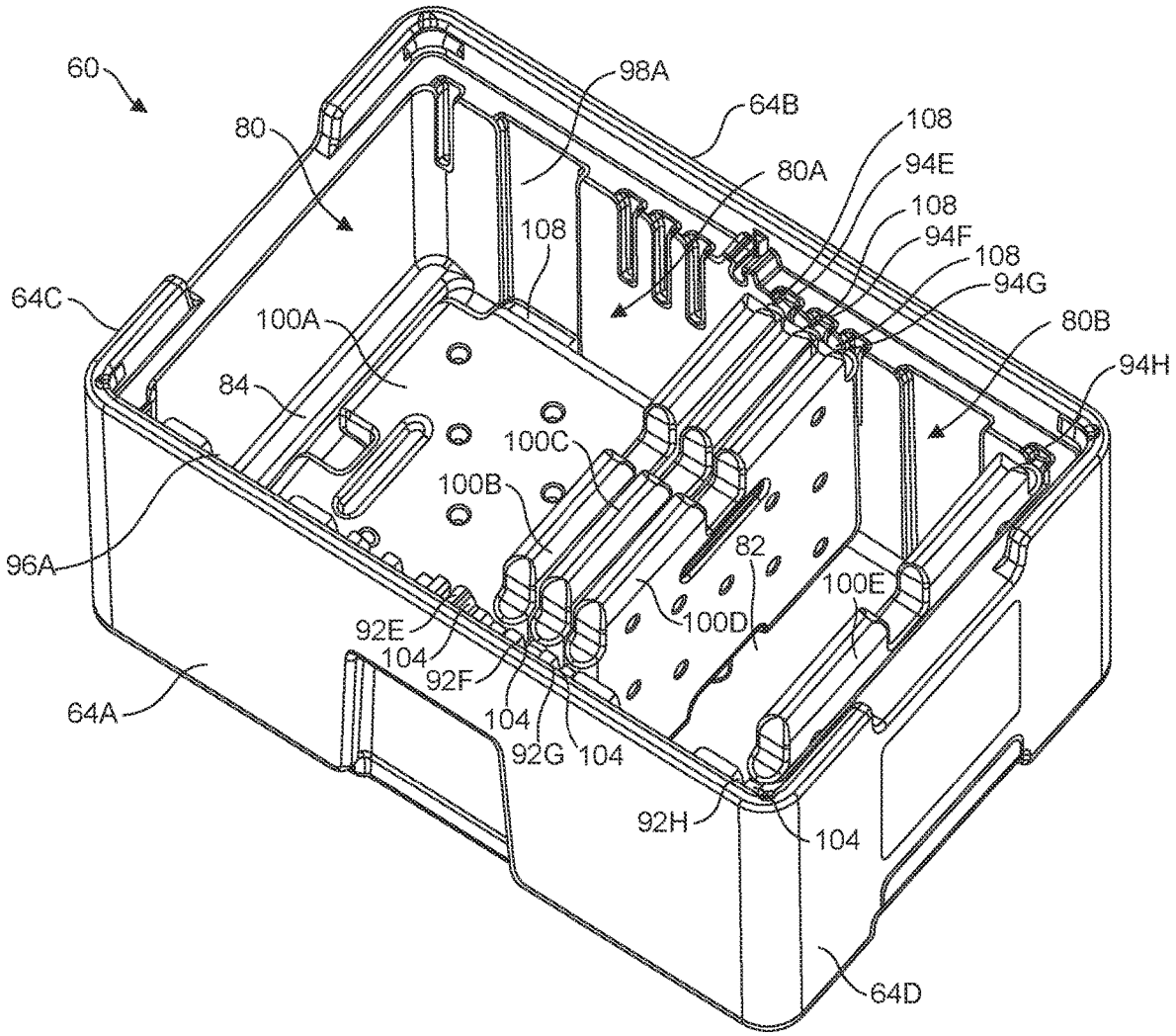
FIG. 16 illustrates the body of FIG. 7 with dividers in a sixth exemplary configuration.

Referring next to FIG. 16, an exemplary body 60 is illustrated with five dividers 100, labeled as first divider 100A, second divider 100B, third divider 100C, fourth divider 100D, and fifth divider 100E. Second divider 100B, third divider 100C, and fourth divider 100D together divider interior cavity 80 between a first portion 80A and a second portion 80B.

First divider 100A is illustratively positioned in the second horizontal orientation. The first projection 104 of first divider 100A is received within groove 96A of first side wall 64A and the second projection 108 of first divider 100A is received within corresponding groove 98A of second side wall 64B. First divider 100A is positioned such that the upper surface 118 is adjacent to raised bottom surface 84, and the divider body 102 is supported by bottom interior surface 82.

Second divider 100B is illustratively positioned in the first vertical orientation, dividing interior cavity 80, with third divider 100C and fourth divider 100D, into a first portion 80A and a second portion 80B. The first projection 104 of second divider 100B is received within groove 92E of first side wall 64A and the second projection 108 of second divider 100B is received within corresponding groove 96E of second side wall 64B. The lower surface 120 of second divider 100B is supported by grooves 92E, 96E a distance $d_7$ (see FIG. 9) above bottom interior surface 82.

Third divider 100C is illustratively positioned in the first vertical orientation, dividing interior cavity 80, with second divider 100B and fourth divider 100D, into a first portion 80A and a second portion 80B. The first projection 104 of third divider 100C is received within groove 92F of first side wall 64A and the second projection 108 of third divider 100C is received within corresponding groove 96F of second side wall 64B. The lower surface 120 of third divider 100C is supported by grooves 92E, 96E a distance $d_7$ (see FIG. 9) above bottom interior surface 82.

Fourth divider 100D is illustratively positioned in the first vertical orientation, dividing interior cavity 80, with second divider 100B and third divider 100C, into a first portion 80A and a second portion 80B. The first projection 104 of fourth divider 100D is received within groove 92G of first side wall 64A and the second projection 108 of fourth divider 100D is received within corresponding groove 96G of second side wall 64B. The lower surface 120 of fourth divider 100D is supported by grooves 92G, 96G a distance $d_7$ (see FIG. 9) above bottom interior surface 82.

Fifth divider 100E is illustratively positioned in the second vertical orientation against second end wall 64D. The first projection 104 of fifth divider 100E is received within groove 92H of first side wall 64A and the second projection 108 of fifth divider 100E is received within corresponding groove 94H of second side wall 64B. The lower surface 120 of fifth divider 100E contacts the raised bottom surface 84.

Figure 17:
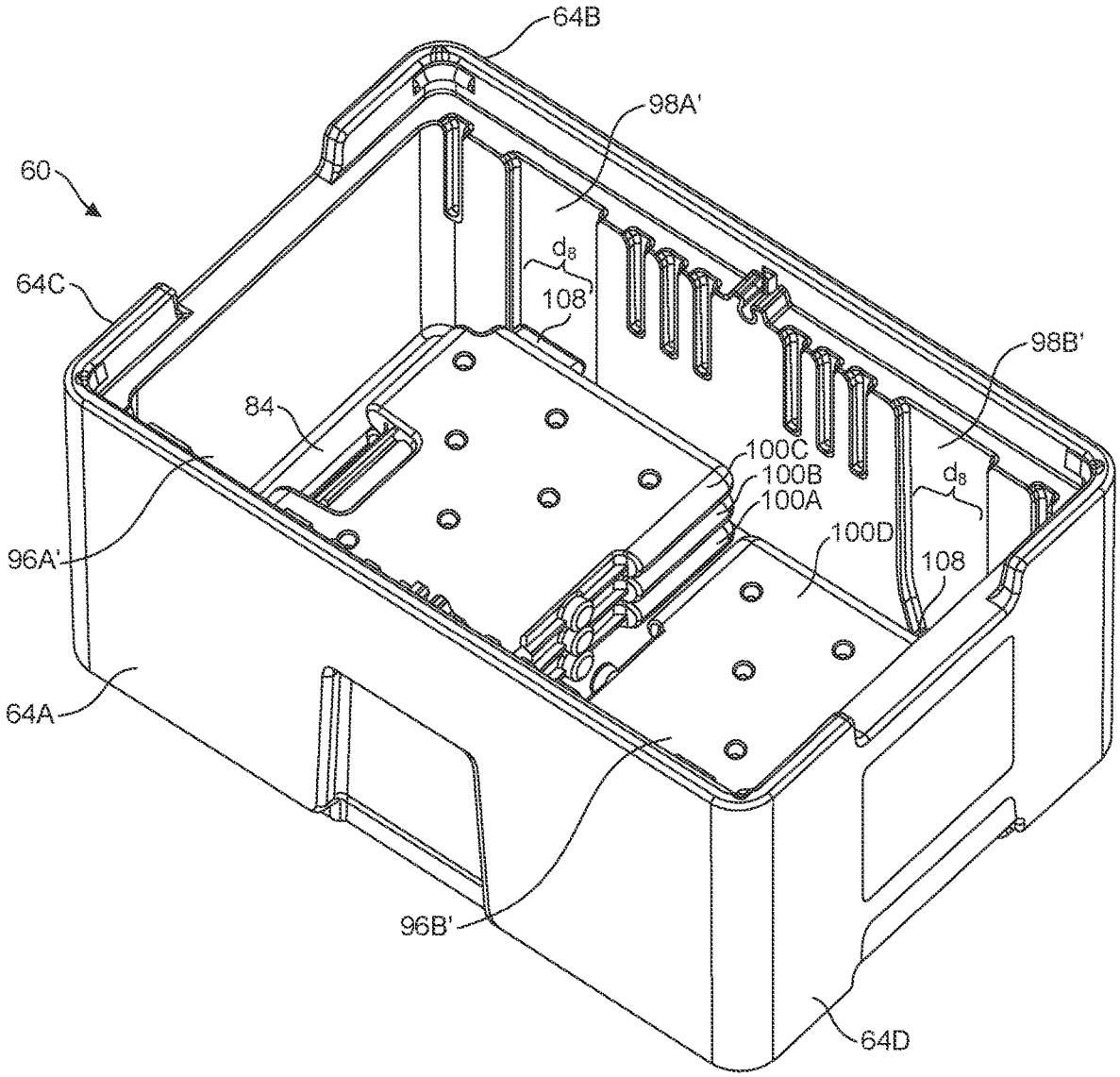
FIG. 17 illustrates the body of FIG. 7 with dividers in a seventh exemplary configuration.

Referring next to FIG. 17, an exemplary body 60 is illustrated with four dividers 100, labeled as first divider 100A, second divider 100B, third divider 100C, and fourth divider 100D.

First divider 100A is illustratively positioned in the second horizontal orientation. The first projection 104 of first divider 100A is received within groove 96A' of first side wall 64A and the second projection 108 of first divider 100A is received within corresponding groove 98A' of second side wall 64B. First divider 100A is positioned such that the upper surface 118 is adjacent to raised bottom surface 84, lower surface 120 is adjacent to second divider 100B, and the divider body 102 is supported by bottom interior surface 82.

Second divider 100B is illustratively positioned in the second horizontal orientation. The first projection 104 of second divider 100B is also received within groove 96A' of first side wall 64A and the second projection 108 of second divider 100B is also received within corresponding groove 98A' of second side wall 64B. Second divider 100B is positioned such that divider body 102 of second divider 100B is supported by the divider body 102 of first divider 100A below it.

Third divider 100C is illustratively positioned in the second horizontal orientation. The first projection 104 of third divider 100C is also received within groove 96A' of first side wall 64A and the second projection 108 of third divider 100C is also received within corresponding groove 98A' of second side wall 64B. Third divider 100C is positioned such that divider body 102 of third divider 100C is supported by the divider body 102 of second divider 1006 below it.

Fourth divider 100D is illustratively positioned in the second horizontal orientation. The first projection 104 of fourth divider 100D is received within groove 96B' of first side wall 64A and the second projection 108 of fourth divider 1006 is received within corresponding groove 98B' of second side wall 64B. Fourth divider 100D is positioned such that the upper surface 118 is adjacent to raised bottom surface 84, lower surface 120 is adjacent to first divider 100A, and the divider body 102 is supported by bottom interior surface 82.

As illustrated in FIG. 17, in some embodiments, one or more grooves, such as grooves 96A', 96B', 98A', and/or 98B' are tapered such that the bottom of the groove has a width dimension $d_4$ (see FIGS. 9, 11) configured to receive the length dimension $d_1$ of either first projection 104 or second projection 108 when divider 100 is in the second horizontal orientation and the corresponding top of each groove has a width dimension $d_8$ that is larger than $d_4$. The use of a tapered groove, such as grooves 96A', 96B', 98A', and/or 98B' may allow the divider 100 to rotate somewhat during insertion and removal of the divider from body 60, making it easier for a user to insert or remove the divider. As further illustrated in FIG. 17, in some embodiments the projections 104, 108 of dividers 100B, 100C may be received at least partially in the portion of the corresponding groove having larger top width $d_8$. In this position, the dividers 100B, 100C may be provided some amount of shifting space while being retained.

As illustrated in the various Figures, many different quantities and configurations of dividers 100 are possible inside body 60. Many different shipping configurations can be created by varying: the number of dividers 100, the locations of dividers 100, thermal characteristics of dividers 100, and thermal states of dividers 100. In doing so, a variety of different shipping compartments having different thermal characteristics can be created. Further, when body 60 is empty or is being return-shipped without items in it, dividers 100 can be placed in other configuration to eliminate or reduce movement. Further, dividers 100 can be placed in various configurations to create a single compartment.

In some examples, different instances of divider 100 may be color coded to indicate dividers having different thermal characteristics or materials.

Figure 18:
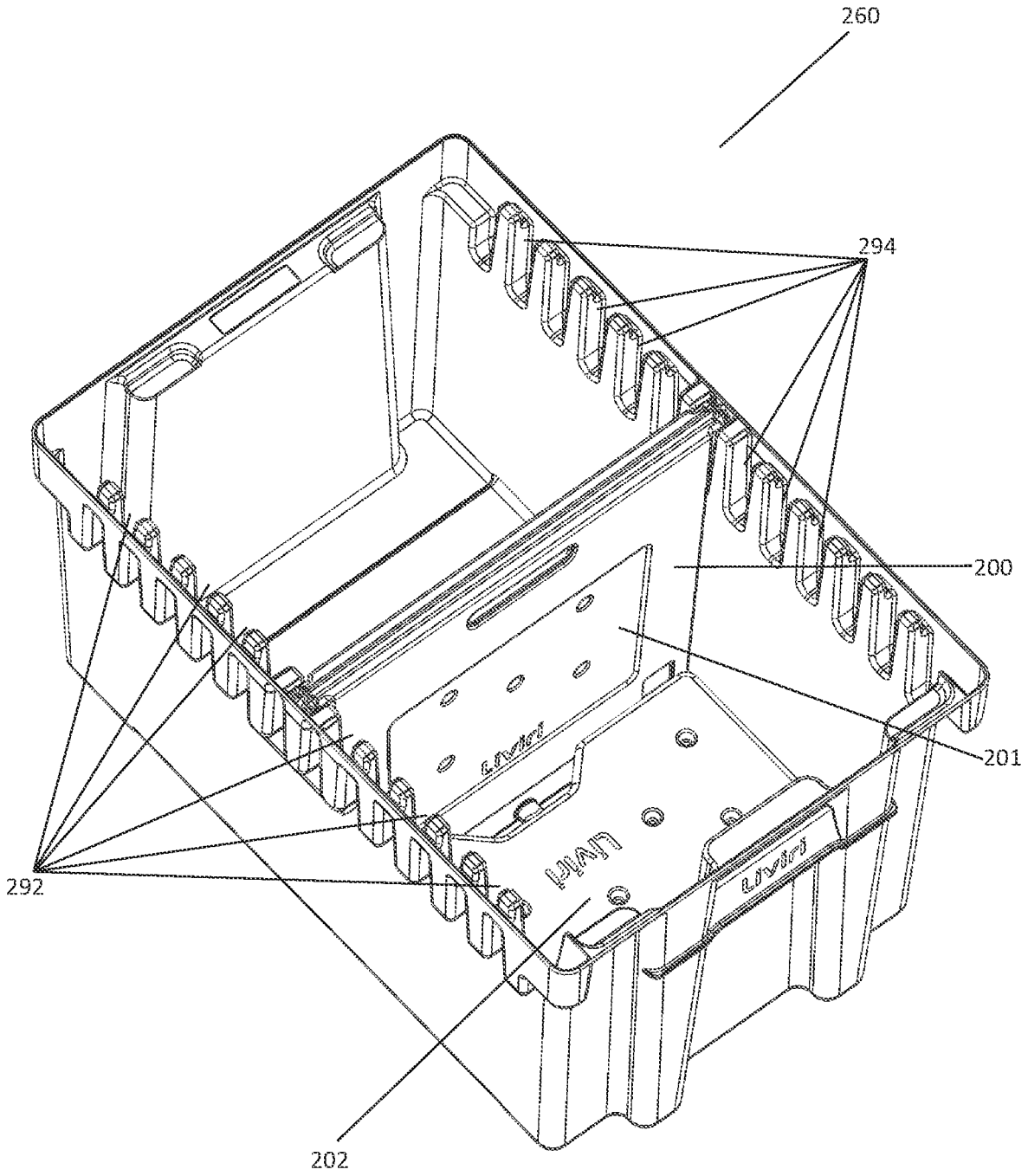
FIG. 18 illustrates a tote with a divider and an ice pack.

FIG. 18 illustrates a tote 260 used in an alternate storage or shipping container system. Tote 260 is a rigid container and may or may not be insulated. Tote 260 may include any of the features or elements of body 60. Tote 260 includes a series of grooves 292 and 294 on opposing side walls of tote 260 for receiving a divider or other element. Grooves 292 and 294 are each examples of grooves 92A-92G and/or 94A-94G. More or fewer grooves may be included. Grooves 292 and 294 are configured for receiving protrusions on a divider, such as divider 200, for separating the interior of tote 260 in two sections. Additional dividers may be used to create more sections or subsections. Each section of tote 260 may be used for an item, or group of items, having a different preferred storage temperature range than an item, or group of items, placed in a different section of tote 260. An insulated divider 200 helps maintain the temperature differential between the sections.

As illustrated in FIG. 18, divider 200 may also include a divider ice pack 201. Divider ice pack 201 may be exposed on one or both sides of divider 200. When divider ice pack 201 is exposed on one side of divider 200 it will serve to keep the section of tote 260 on that side of the divider colder than the other section(s). One or more ice packs, such as ice pack 202 may also be used with tote 260 to keep an associated section colder. Ice pack 202 may be sized such that it can rest horizontally on a bottom of a section of tote 260. In some examples, different sizes of ice pack 202 may be chosen to coincide with different positions of divider 200. Use of additional ice packs is possible. Ice packs having different thermal capacities may also be used. Divider ice pack 201 and/or ice pack 202 may have any of the features, elements, or characteristics of ice pack 100.

Figure 19:
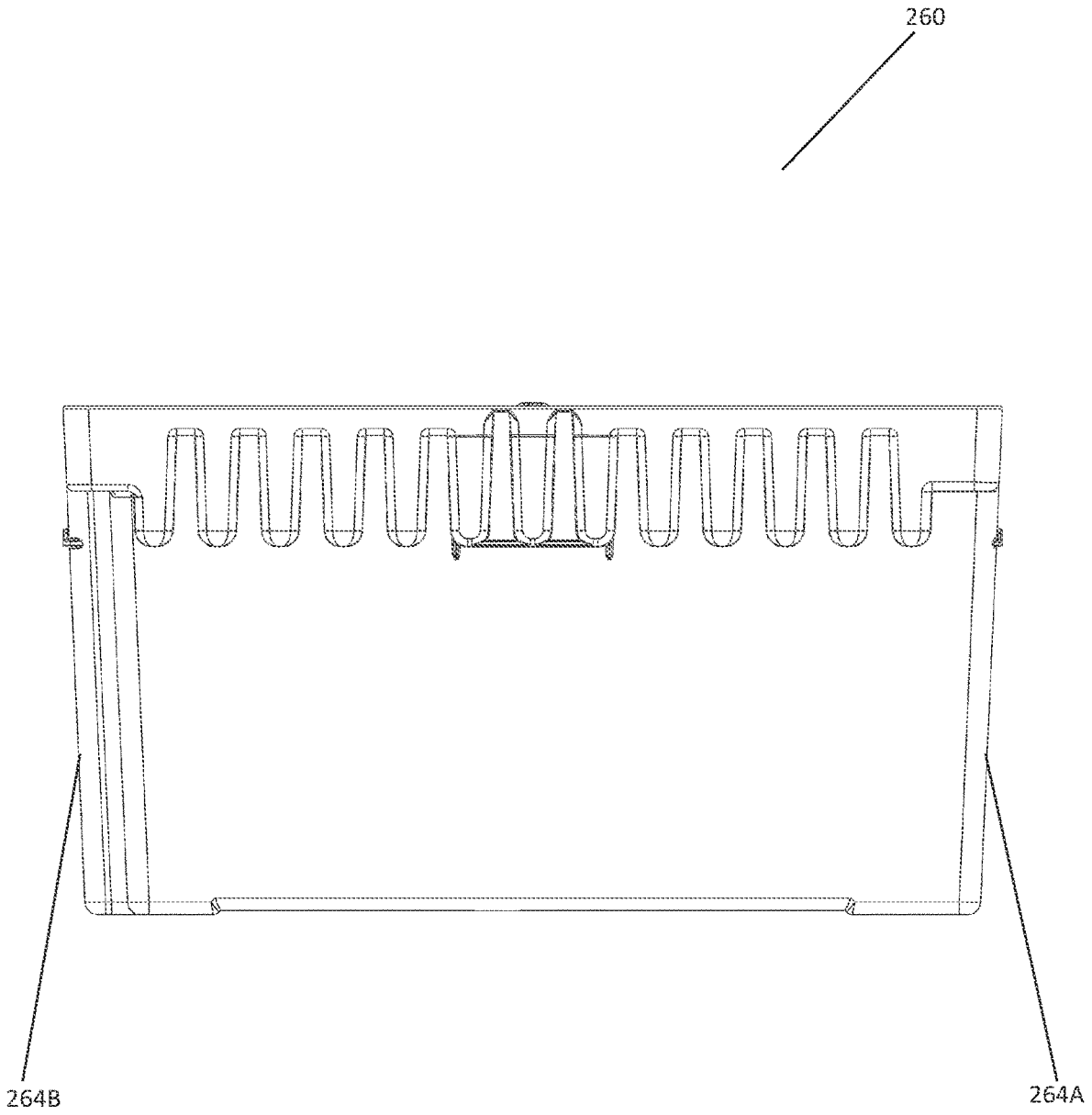
FIG. 19 illustrates a side view of the tote of FIG. 18.
Figure 20:
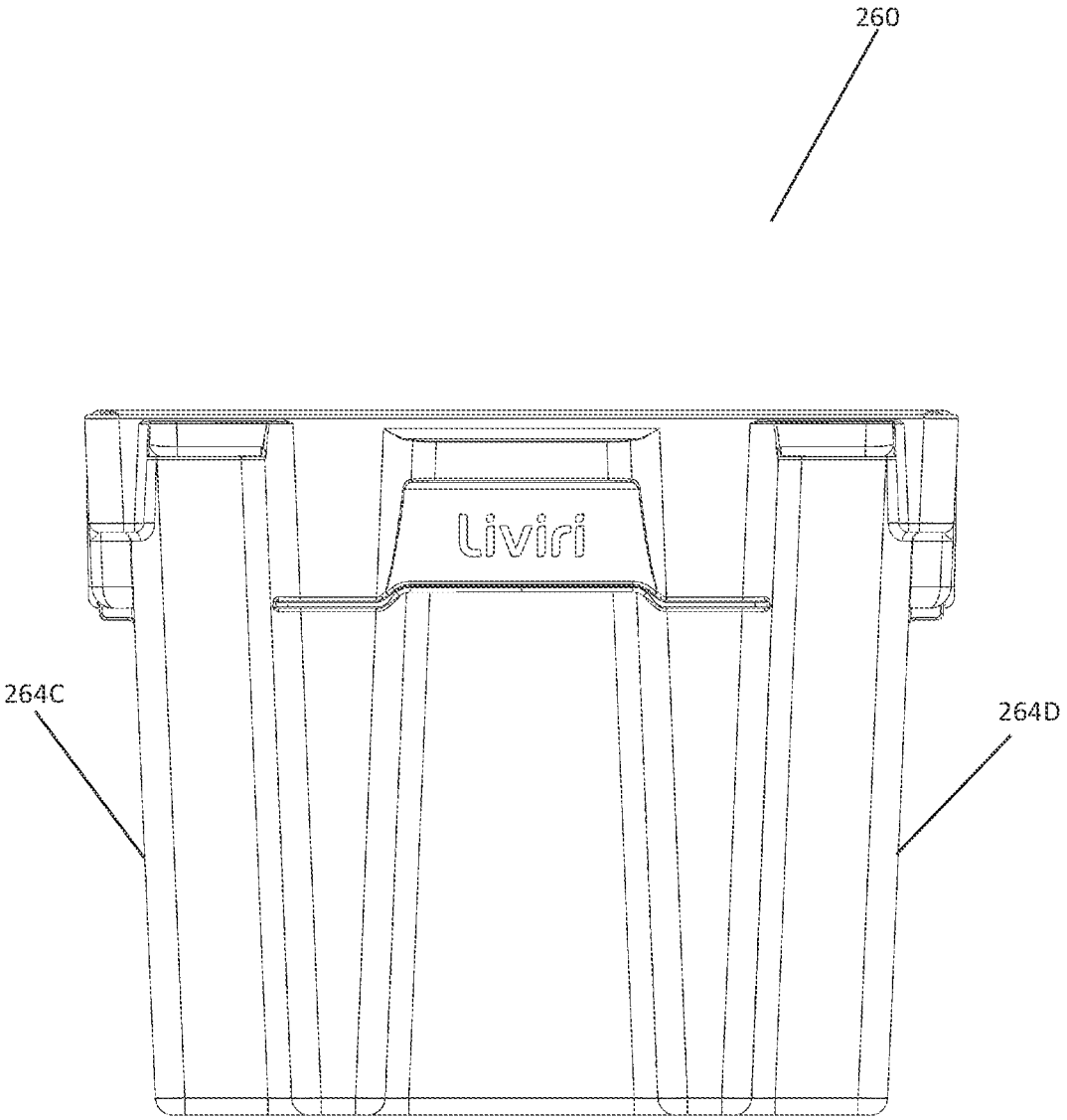
FIG. 20 illustrates an end view of the tote of FIG. 18.

FIG. 19 illustrates a side view of tote 260. As illustrated, the opposing side walls 264A and 264B are tapered inward from top to bottom such that the bottom of tote 260 is smaller than the top. Similarly, FIG. 20 illustrates an end view of tote 260 and illustrates that opposing side walls 264C and 264D are also tapered inward. This configuration enables a plurality of totes 260 to at least partially nest within each other when not in use and stacked on top of each other. In this way, the nesting stackability of multiple instances of tote 260 can result in significant space savings.

Figure 21:
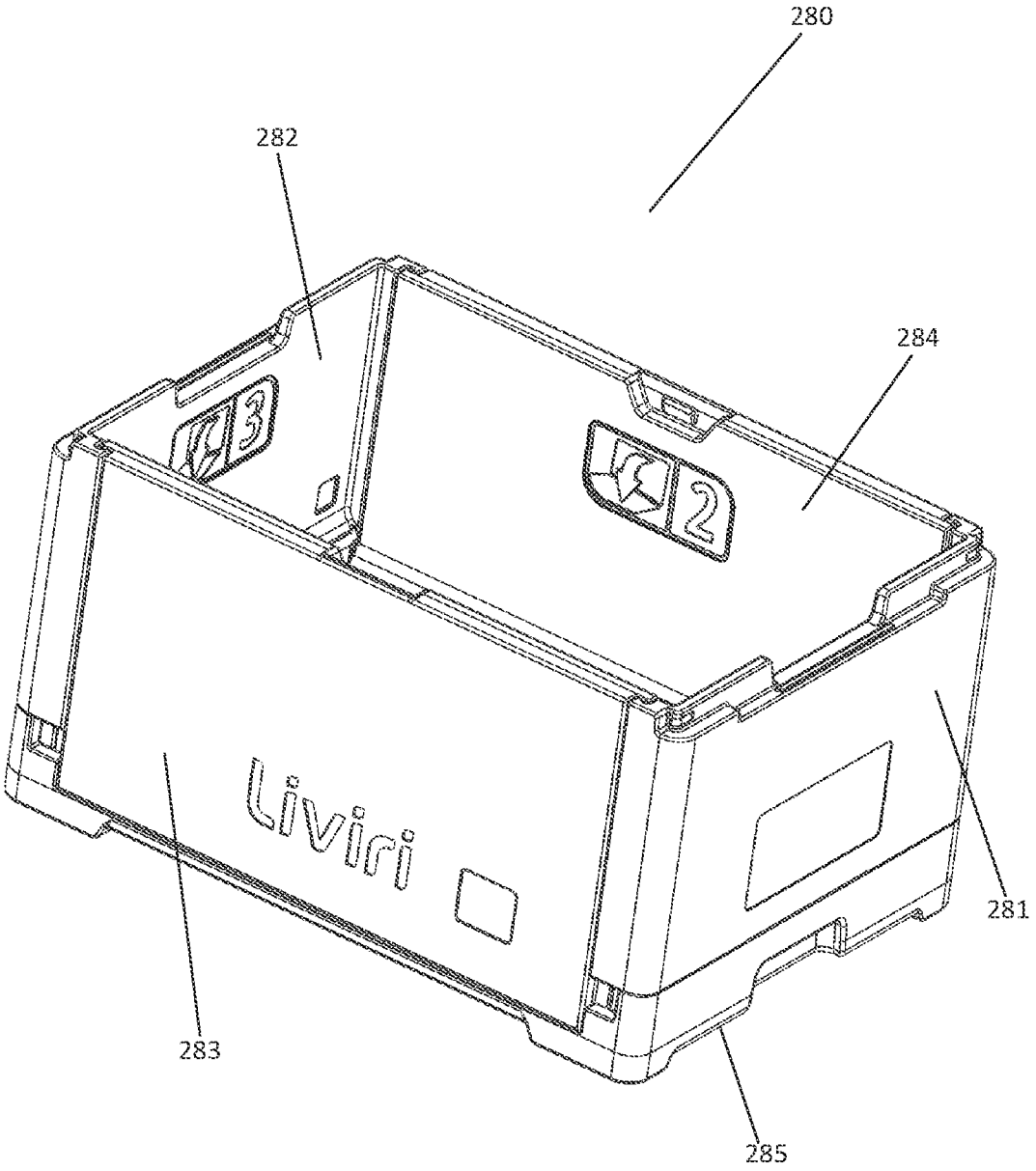
FIG. 21 illustrates an insulated shell for the tote of FIG. 18.

FIG. 21 illustrates an insulated shell 280 for use with tote 260 and/or with other items. Insulated shell 280 includes a bottom 285 and sides 281-284. Insulated shell 280 provides a removable outer layer of insulation which can optionally be used with another container, such as tote 260. Insulated shell 280 may utilize one or more insulating elements, such as foam, expanding foam, closed cell foam, structural foam, spray foam, blanket materials, one or more evacuated cavities, one or more vacuum panels, or combinations thereof. In some examples, insulated shell 280 may be made from two or more layers of different materials. In other examples, insulated shell 280 may be formed from a single material. In one specific example, insulated shell 280 is formed from a structural foam, such as expanded polypropylene. As discussed in further detail below, each of sides 281-284 is pivotably or hingedly attached to bottom 285 such that they can be folded down when insulated shell 280 is not in use thereby transitioning insulated shell 280 from the illustrated expanded configuration to a collapsed configuration (see FIG. 23).

Figure 22:
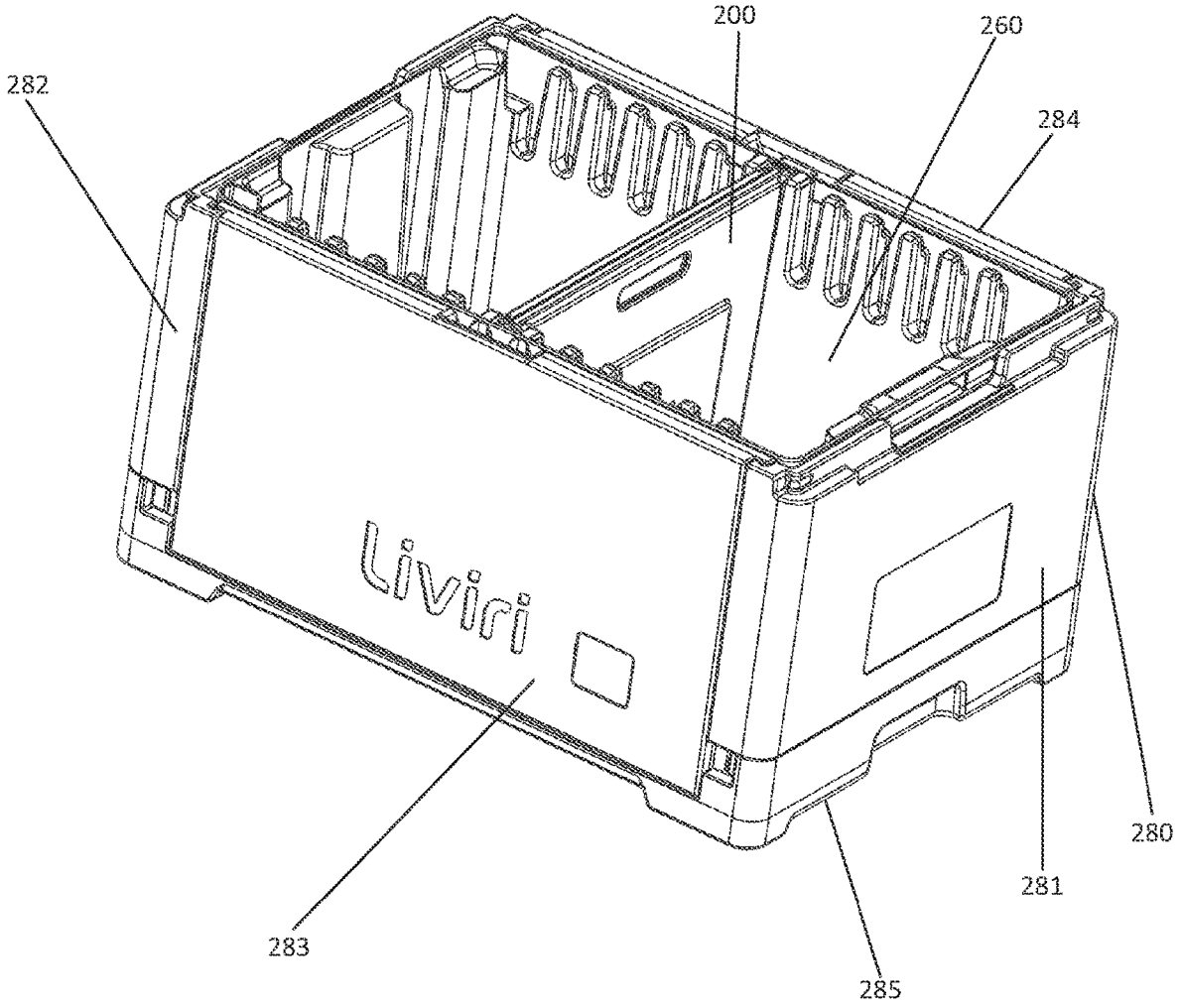
FIG. 22 illustrates the tote of FIG. 18 in the insulated shell of FIG. 21.

FIG. 22 illustrates tote 260 inserted into insulated shell 280 of FIG. 21. In one use model, tote 260 may be used when picking or fulfilling a grocery or food order. Divider 200 may be used to separate items with different temperature requirements. After the items are placed in tote 260, the items may be delivered within a relatively short period of time or tote 260 may be stored in a cooled environment. In these situations, the extra insulation of insulated shell 280 may not be needed, or may not be needed yet. However, if tote 260 is not stored in a temperature controlled area, is being shipped a significant distance, may not be delivered for a significant period of time, or may sit at a delivery location for a while before being picked up, tote 260 can optionally be placed in insulated shell 280 to better maintain the temperature of the items inside. The term 'shipping' may be used herein to refer transporting goods a wide range of distances including local delivery from a grocery store to a residence or shipping across many states. Different variations of insulated shell may be implemented with different grades or amounts of insulation.

Figure 23:
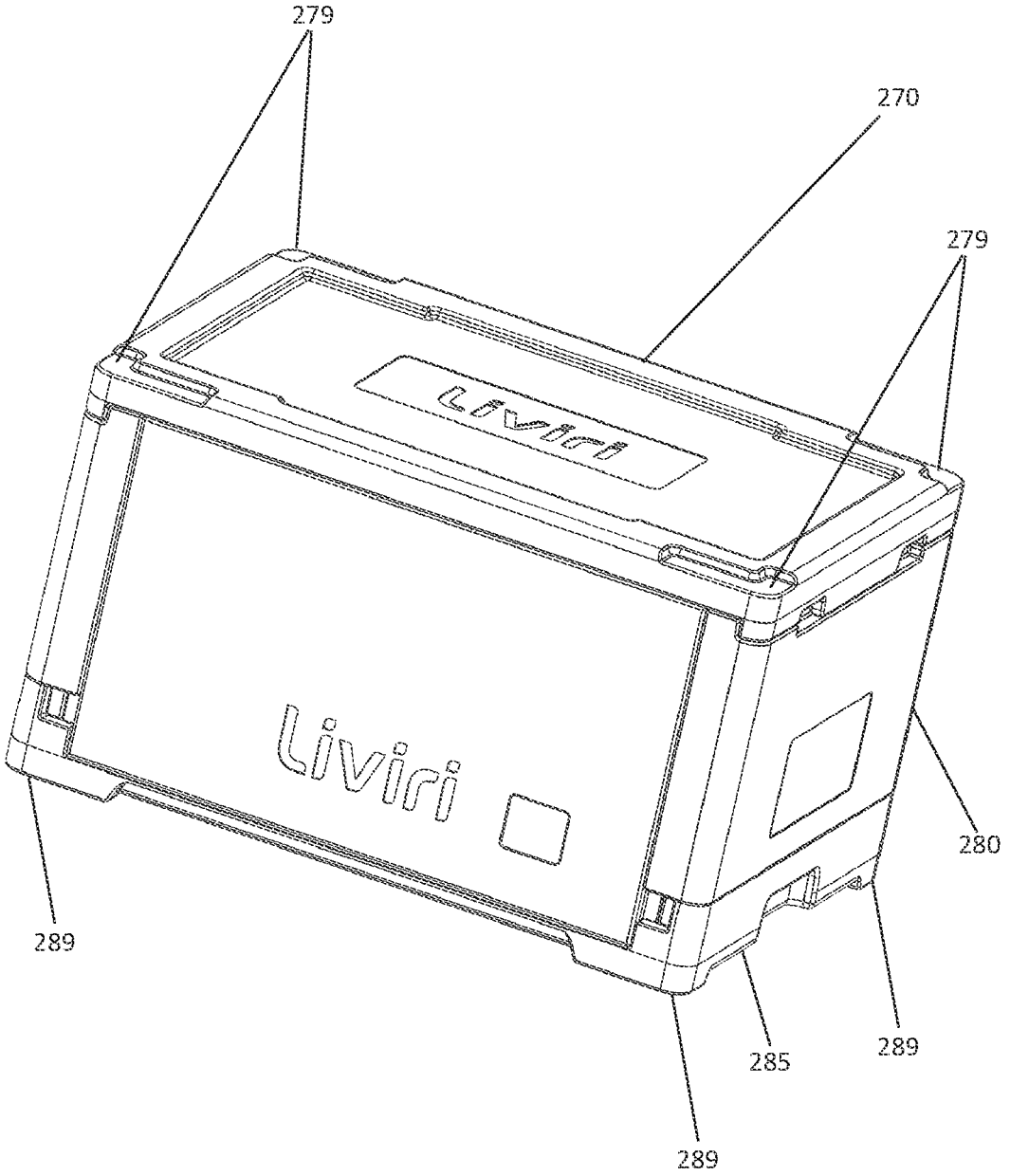
FIG. 23 illustrates the insulated shell of FIGS. 21 and 22 with a lid.

FIG. 23 illustrates insulated shell 280 with an insulated lid 270. The bottom 285 of insulated shell 280 includes feet 289 at or near the corners. Lid 270 includes recesses 279 for receiving feet 289 of another instance of insulated shell 280 that may be stacked on top of lid 270. This engagement of feet 289 and recesses 279 results in more consistent and stable stacking of the insulated shells on top of each other, whether or not totes 260 are inside. This stacking benefit can also be realized when insulated shell 280 is in the collapsed configuration (see FIG. 25).

Figure 24:
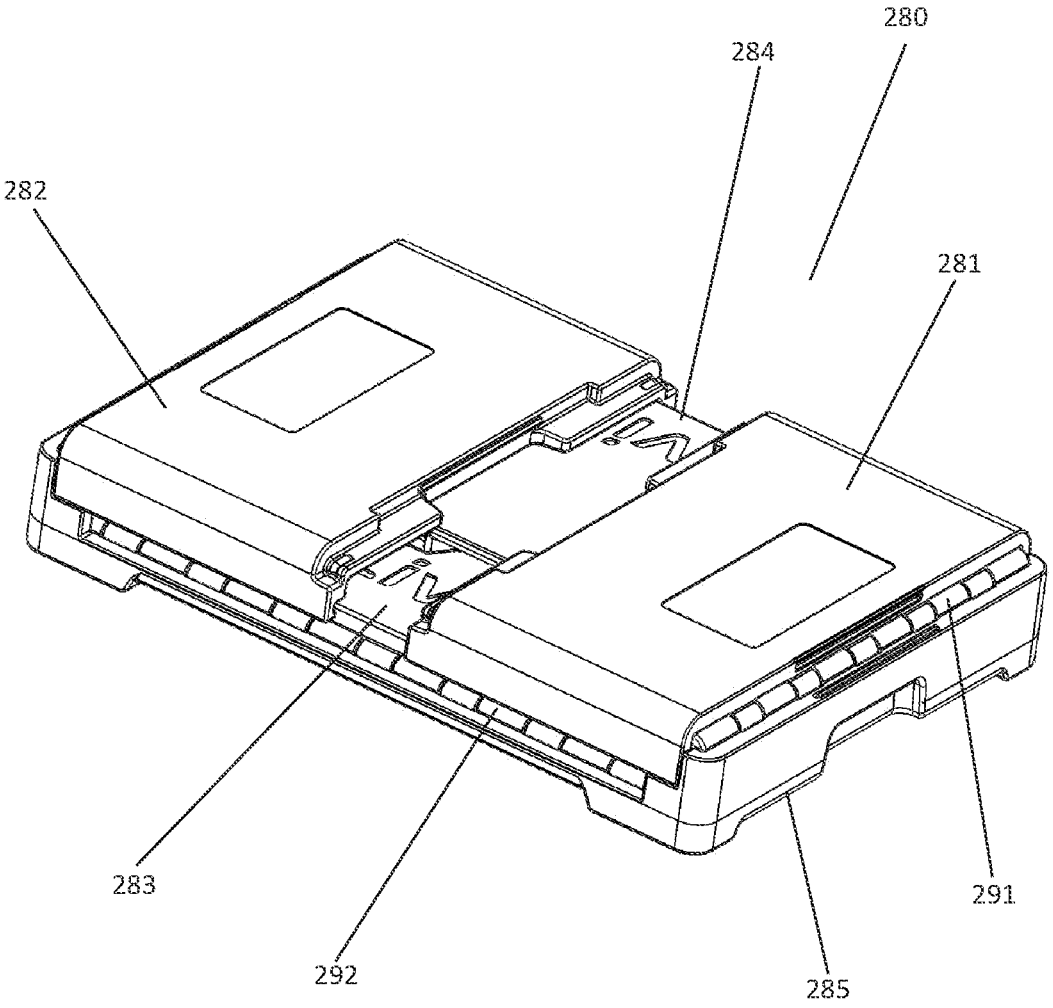
FIG. 24 illustrates the insulated shell of FIG. 21 in a collapsed configuration.
Figure 25:
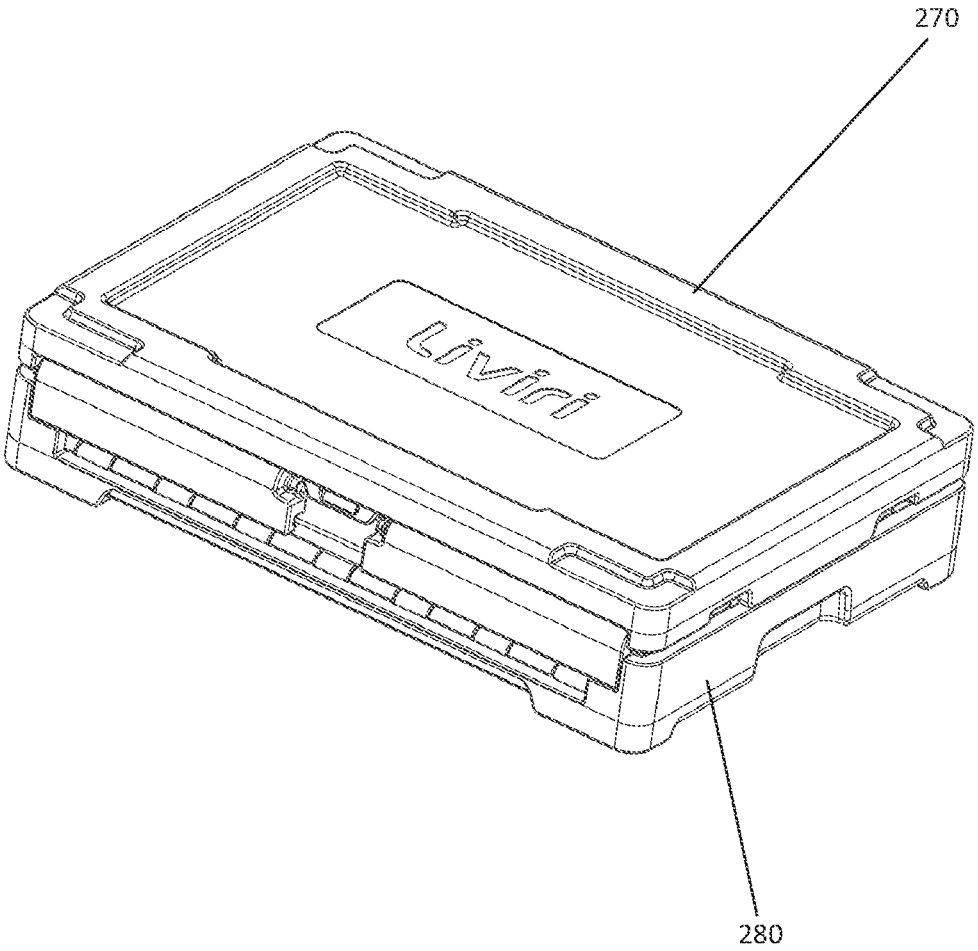
FIG. 25 illustrates the insulated shell of FIG. 24 with a lid.

FIG. 24 illustrates insulated shell 280 in the collapsed configuration. Each of sides 281-284 folds down and inward to achieve the illustrated collapsed configuration. The folding is accomplished using hinges or hinging elements, such as hinges 291 and 292. FIG. 25 illustrates insulated shell 280 in the collapsed configuration of FIG. 24 with insulated lid 270 in place.

Figure 26A:
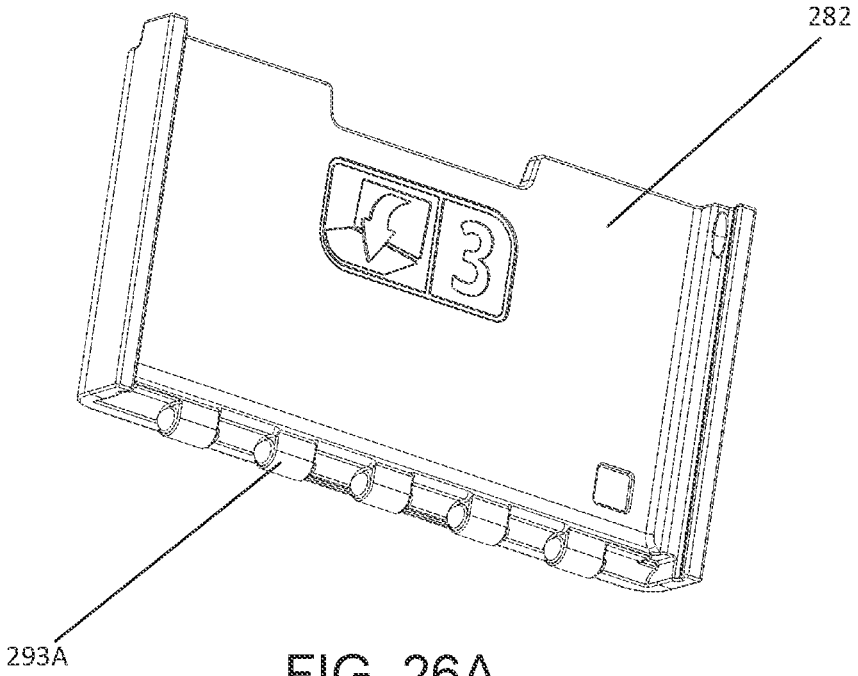
FIG. 26A illustrates a close up view of a hinge portion of a side wall of the insulated shell of FIG. 21.
Figure 26B:
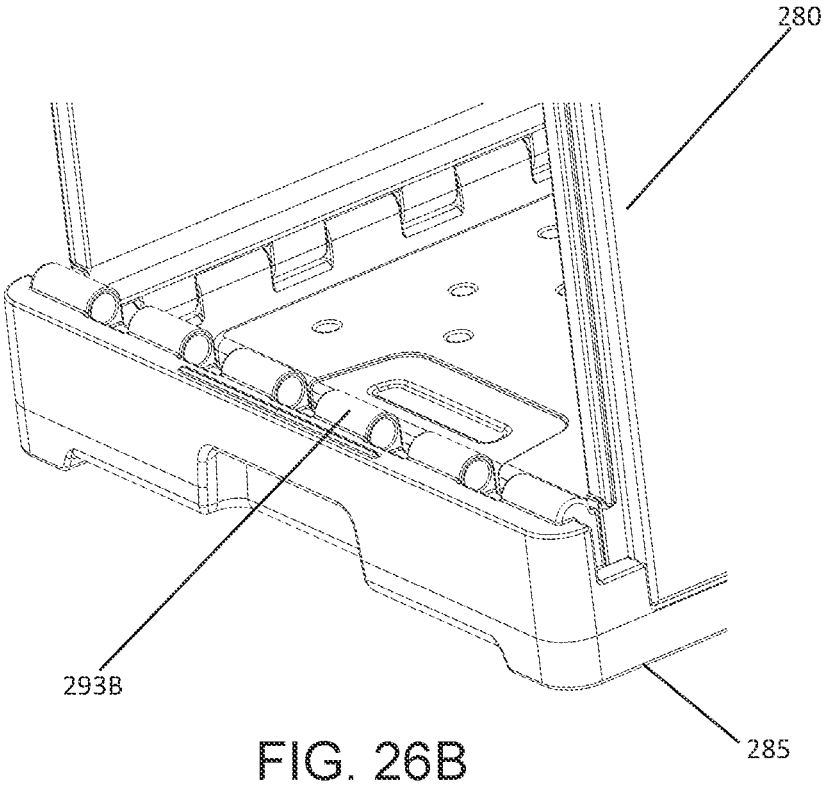
FIG. 26B illustrates a close up view of a hinge portion of a bottom of the insulated shell of FIG. 21.

FIG. 26A illustrates a close up view of a portion of side wall 282 of insulated shell 280 while it is not attached to insulated shell 280. Side wall 282 includes a hinge portion 293A which forms a portion of a hinge, which is similar to hinges 291 and 292 of FIG. 24. FIG. 26B illustrates a close up view of a portion of insulated shell 280 with side wall 282 removed. Specifically, FIG. 26B illustrates the hinge portion 293B which mates with hinge portion 293A to form the hinge. In one example, both hinge portions 293A and 293B are formed from a structural foam material that makes up some or all of the remainder of insulated shell 280. Hinge portions 293A and 293B may have a friction or interference fit with each other enabling them to snap together. After engagement, it may take minimal force to rotatably, pivotably, or hingedly move side wall 282 with respect to bottom 285. However, it would take significantly more force to remove side wall 282 by overcoming the friction or interference fit of hinge portions 293A and 293B. This design is beneficial in that hinges may be formed from a same material as the rest of the insulated shell and also makes the side walls easily removable for replacement or cleaning.

Any of the components disclosed herein may include or may be coated with an anti-microbial and/or anti-viral substance or ingredient.

Any of the techniques, improvements, features, functions, or processes described herein may be implemented in the form of a system or a kit. The system or kit may include any combination of the devices, components, elements, and/or modules disclosed herein.

The techniques, elements, components, methods, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "on other examples," "in some cases," "in some situations," "in one configuration," "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure is presented for purposes of illustration and description. Other modifications and variations may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention except as limited by the prior art.

What is claimed is:

1. A configurable storage container for storing items, the configurable storage container comprising:

a first divider having a divider body and a first projection extending from the divider body, wherein the first projection has a length having a first dimension and a width having a second dimension that is different than the first dimension;

an insulated container body having an internal cavity configured for receiving the items, wherein the internal cavity is at least partially bounded by a bottom, a first wall, and a second wall opposite the first wall, wherein the first wall includes a first groove facing inward toward the internal cavity, wherein the first groove has a width configured to receive the width of the first projection of the first divider in a first orientation, wherein at least one of the first wall and the second wall includes a second groove also facing inward toward the internal cavity, wherein the second groove has a width configured to receive the length of the first projection in a second orientation, wherein the width of the second groove is different than the width of the first groove; and a lid configured to engage the insulated container body to close the internal cavity.

2. The configurable storage container of claim 1 wherein the first groove is parallel to the second groove.

3. The configurable storage container of claim 1 wherein the first wall includes both the first groove configured to receive first projection of the first divider in the first orientation and the second groove configured to receive the first projection of the first divider in the second orientation, and wherein the first groove will not receive the first projection in the second orientation.

4. The configurable storage container of claim 3 wherein the first projection is positioned on a first side of the first divider and the first divider further comprises a second projection positioned on a second side of the first divider opposite the first side, wherein the second projection has a length having the first dimension and a width having the second dimension.

5. The configurable storage container of claim 4 wherein the second wall of the insulated container body includes a third groove configured to receive second projection of the first divider in the first orientation and a fourth groove configured to receive the second projection of the first divider in the second orientation.

6. The configurable storage container of claim 1 wherein the first divider is configured to be positioned in a vertical orientation in the first orientation and a horizontal orientation perpendicular to the vertical orientation in the second orientation.

7. The configurable storage container of claim 6 wherein the second groove extends from a top having a top width to a bottom having a bottom width configured to receive the length of the first projection, the top width being larger than the bottom width.

8. The configurable storage container of claim 7 wherein the second groove has a length that is longer than a length of the first groove.

9. The configurable storage container of claim 8 wherein the first groove is configured to contact the first divider above the bottom of the insulated body in the second orientation.

10. The configurable storage container of claim 1 further comprising a second divider wherein the second divider includes a first projection, wherein the first projection has a length having the first dimension and a width having the second dimension, wherein the first groove is configured to receive the first projection of the second divider in a first orientation and wherein the second groove is configured to receive the first projection of the second divider in a second orientation.

11. The configurable storage container of claim 10 wherein the second divider is identical to the first divider.

12. The configurable storage container of claim 1 wherein the first divider is insulated.

13. The configurable storage container of claim 1 wherein the first divider includes one of an ice pack or a liquid cold pack.

14. A configurable container for transporting one or more items, the configurable container comprising:

a first divider having a divider body and a first projection extending from the divider body, wherein the first projection has a length having a first dimension and a width having a second dimension different than the first dimension; and a container body having an internal cavity configured for receiving the one or more items, wherein the internal cavity is at least partially bounded by a bottom, a first wall, and a second wall opposite the first wall, wherein the first wall includes a first groove facing inward toward the internal cavity, wherein the first groove has a width configured to receive the width of the first projection of the first divider in a first orientation, wherein at least one of the first wall and the second wall includes a second groove also facing inward toward the internal cavity, wherein the second groove has a width configured to receive the length of the first projection in a second orientation, wherein the width of the second groove is different than the width of the first groove.

15. The configurable container of claim 14 wherein the first wall includes both the first groove configured to receive first projection of the first divider in the first orientation and the second groove configured to receive the first projection of the first divider in the second orientation, and wherein the first groove will not receive the first projection in the second orientation.

16. The configurable container of claim 15 wherein the first projection is positioned on a first side of the first divider and the first divider further comprises a second projection positioned on a second side of the first divider opposite the first side, wherein the second projection has a length having the first dimension and a width having the second dimension.

17. The configurable container of claim 16 wherein the second wall of the container body includes a third groove configured to receive second projection of the first divider in the first orientation and a fourth groove configured to receive the second projection of the first divider in the second orientation.

18. The configurable container of claim 14 wherein the first divider is configured to be positioned in a vertical orientation in the first orientation and a horizontal orientation perpendicular to the vertical orientation in the second orientation.

19. The configurable container of claim 14 further comprising a second divider identical to the first divider and a lid configured to selectively close the internal cavity of the container body.

20. The configurable container of claim 14 wherein the container body is insulated and the first divider is an ice pack.

* * * * *